US010377139B2

(12) United States Patent
Iida

(10) Patent No.: US 10,377,139 B2
(45) Date of Patent: Aug. 13, 2019

(54) LIQUID EJECTION APPARATUS

(71) Applicant: BROTHER KOGYO KABUSHIKI KAISHA, Nagoya-shi, Aichi-ken (JP)

(72) Inventor: Shotaro Iida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/878,529

(22) Filed: Jan. 24, 2018

(65) Prior Publication Data

US 2018/0215155 A1 Aug. 2, 2018

(30) Foreign Application Priority Data

Jan. 31, 2017 (JP) ..... 2017-016335

(51) Int. Cl.
*B41J 2/165* (2006.01)

(52) U.S. Cl.
CPC ..... *B41J 2/16505* (2013.01); *B41J 2/1652* (2013.01); *B41J 2/16508* (2013.01); *B41J 2/16517* (2013.01); *B41J 2/16523* (2013.01); *B41J 2/16532* (2013.01)

(58) Field of Classification Search
CPC ..... B41J 2/16505; B41J 2/16508; B41J 2/16523; B41J 2/16517; B41J 2/16532; B41J 2/1652
See application file for complete search history.

(56) References Cited

U.S. PATENT DOCUMENTS

2007/0206048 A1 9/2007 Kusunoki et al.
2008/0143780 A1* 6/2008 Sakamoto ..... B41J 2/16508 347/32

FOREIGN PATENT DOCUMENTS

| | | | |
|---|---|---|---|
| JP | 2006-159717 | A | 6/2006 |
| JP | 2007-130861 | A | 5/2007 |
| JP | 4854276 | B2 | 1/2012 |
| JP | 2012-096367 | A | 5/2012 |
| JP | 5309439 | B2 | 10/2013 |
| JP | 2016-175361 | A | 10/2016 |

OTHER PUBLICATIONS

IP.com search (Year: 2019).*

* cited by examiner

*Primary Examiner* — Lisa Solomon
(74) *Attorney, Agent, or Firm* — Scully, Scott, Murphy & Presser, PC

(57) ABSTRACT

A liquid ejection apparatus, including: a head having nozzles; a cap to cover the nozzles; a pump fluidically connected to the cap; a switcher for switching a state of the cap between a capping state and an uncapping state, and a controller configured to: determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and control the head based on the determined cap parameter to perform a flushing for discharging the liquid from the nozzles.

23 Claims, 15 Drawing Sheets

FIG.4A

| Ec \ Tc1 | T11≤Tc1<T12 | T12≤Tc1<T13 | Tc1≥T13 |
|---|---|---|---|
| Ec11≤Ec<Ec12 | F111 | F121 | F131 |
| Ec12≤Ec<Ec13 | F112 | F122 | F132 |
| Ec≥E13 | F113 | F123 | F133 |

FIG.4B

| Ec \ Tc2 | T21≤Tc2<T22 | T22≤Tc2<T23 | Tc2≥T23 |
|---|---|---|---|
| Ec21≤Ec<Ec22 | NO DISCHARGE | NO DISCHARGE | F231 |
| Ec22≤Ec<Ec23 | NO DISCHARGE | F222 | F232 |
| Ec23≤Ec<Ec24 | F213 | F223 | F233 |
| Ec24≤Ec<Ec25 | F214 | F224 | Pg2 |
| Ec≥E25 | F215 | Pg1 | Pg3 |

LIQUID EJECTION APPARATUS

CROSS REFERENCE TO RELATED APPLICATION

The present application claims priority from Japanese Patent Application No. 2017-016335, which was filed on Jan. 31, 2017, the disclosure of which is herein incorporated by reference in its entirety.

BACKGROUND

Technical Field

The following disclosure relates to a liquid ejection apparatus configured to eject a liquid from nozzles.

Description of Related Art

As one example of a liquid ejection apparatus configured to eject a liquid from nozzles, there is known a printer configured to eject ink from nozzles. The known printer performs a discharge processing (flushing) for discharging ink from the nozzles to a cap. In the printer, the nozzles are covered by the cap in a standby state in which printing is not performed, so as to prevent or reduce an increase in the viscosity of ink in the nozzles.

SUMMARY

In the printer described above, ink remains in the cap to some extent after the discharge processing has been performed. From the ink remaining in the cap, water (moisture) evaporates in a period in which the nozzles are not covered by the cap, such as in printing, so that an amount of water in the remaining ink decreases, namely, an evaporation rate of water becomes high. In the meantime, ink generally contains a humectant for suppressing evaporation of water. Thus, when the nozzles are covered by the cap in a state in which the evaporation rate of water in the ink remaining in the cap is high, the humectant contained in the ink in the cap absorbs water in the ink in the nozzles. This undesirably lowers an effect of suppressing an increase in the viscosity of the ink by covering the nozzles with the cap. If the ink is frequently discharged into the cap by frequently performing a purging, for instance, the amount of water in the ink in the cap does not decrease. In this case, however, a discharge amount of the ink is undesirably increased.

Accordingly, the present disclosure relates to a liquid ejection apparatus capable of keeping, at a low level, an evaporation rate of water in a liquid in nozzles and a cap and capable of minimizing an amount of the liquid discharged to this end.

In one aspect of the present disclosure, a liquid ejection apparatus includes: a liquid ejection head having nozzles; a cap configured to cover the nozzles; a pump fluidically connected to the cap; a switcher configured to switch a state of the cap between a capping state in which the cap contacts the liquid ejection head so as to cover the nozzles and an uncapping state in which the cap is spaced apart from the liquid ejection head; and a controller, wherein the controller is configured to: determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and control the liquid ejection head based on the determined cap parameter so as to cause the liquid ejection head to perform a flushing for discharging the liquid from the nozzles is performed.

In another aspect of the present disclosure, a liquid ejection apparatus includes: a liquid ejection head having nozzles; a cap configured to cover the nozzles; a pump fluidically connected to the cap; a switcher configured to switch a state of the cap between a capping state in which the cap contacts the liquid ejection head so as to cover the nozzles and an uncapping state in which the cap is spaced apart from the liquid ejection head; and a controller, wherein the controller is configured to: determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and control the switcher and the pump based on the determined cap parameter to switch the state of the cap to the capping state and thereafter discharge the liquid from the nozzles to the cap.

In still another aspect of the present disclosure, a liquid ejection apparatus includes: a liquid ejection head having nozzles; a cap configured to cover the nozzles; a first pump fluidically connected to the cap; a second pump fluidically connected to the liquid ejection head, the second pump configured to give a pressure for discharging the liquid from the nozzles; a switcher configured to switch a state of the cap between a capping state in which the cap contacts the liquid ejection head so as to cover the nozzles and an uncapping state in which the cap is spaced apart from the liquid ejection head; and a controller, wherein the controller is configured to: determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and control the switcher and the second pump based on the determined cap parameter to switch the state of the cap to the capping state and thereafter discharge the liquid from the nozzles to the cap.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which:

FIG. 4A is a table indicating a relationship between: cap parameter and length of time of the most recent capping state; and discharge amount in pre-printing flushing;

FIG. 4B is a table indicating a relationship between: cap parameter and length of time of the most recent capping state; and determination as to whether flushing or suction purging is to be performed in a regular maintenance and discharge amount when the flushing or the suction purging is performed.

DETAILED DESCRIPTION OF THE EMBODIMENTS

There will be described one embodiment of the present disclosure.

Overall Structure of Printer

Figure 1:
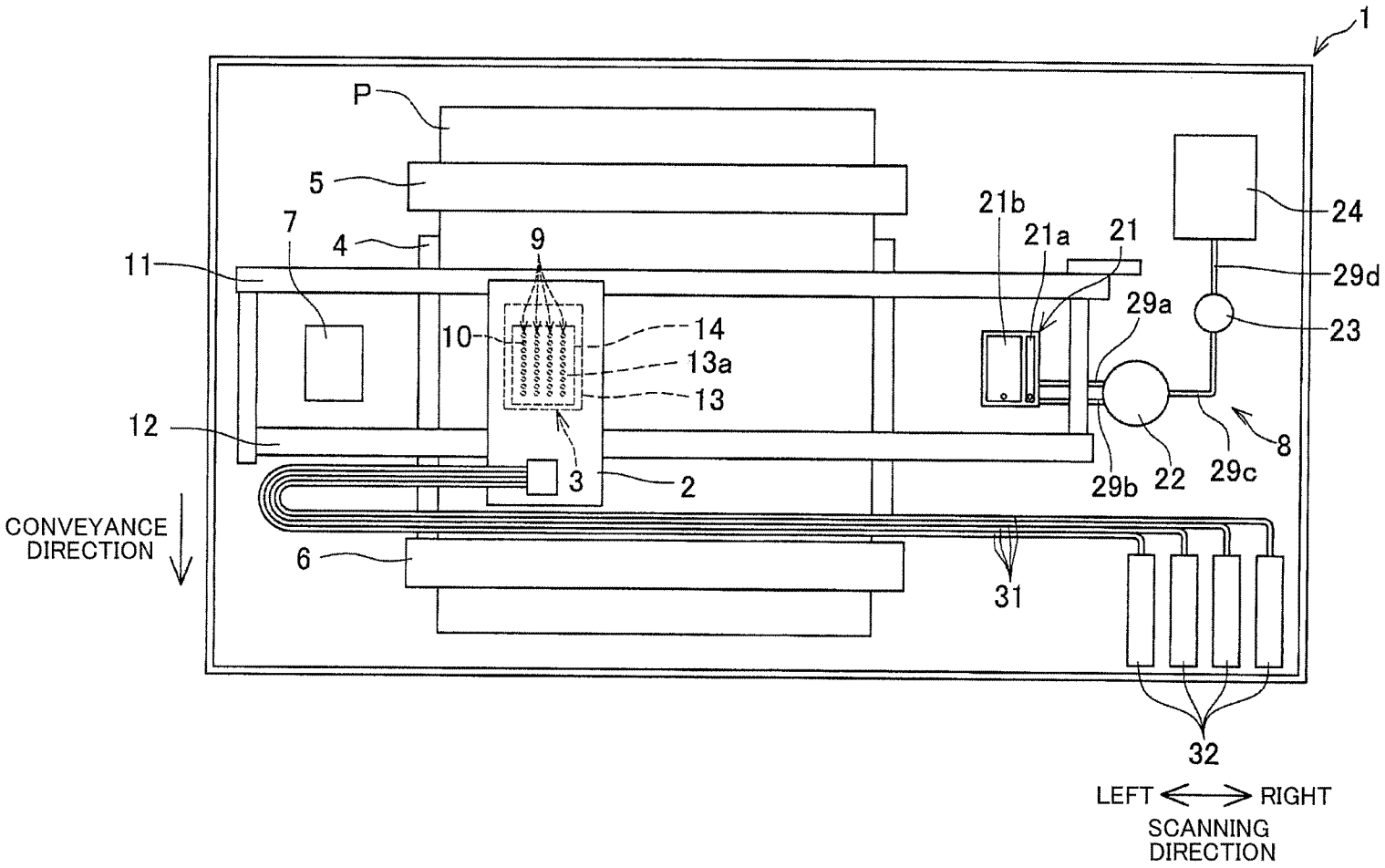
FIG. 1 is a schematic view of a printer according to a first embodiment.

As shown in FIG. 1, a printer 1 according to the present embodiment includes a carriage 2, an ink-jet head 3 (as one example of "liquid ejection head"), a platen 4, conveyance rollers 5, 6, a flushing foam 7, and a maintenance unit 8.

The carriage 2 is supported by two guide rails 11, 12 extending in a scanning direction. The carriage 2 is connected to a carriage motor 56 (FIG. 2) via a belt (not shown), for instance. When the carriage motor 56 is driven, the carriage 2 moves in the scanning direction along the guide rails 11, 12. In the first embodiment, a combination of the carriage 2, the carriage motor 56 for moving the carriage 2 in the scanning direction, etc., is one example of "head moving device". The following explanation will be made regarding, as a right side, a side nearer to ink cartridges 32 in a direction parallel to the scanning direction in FIG. 1 and regarding, as a left side, a side farther from the ink cartridges 32 in the direction parallel to the scanning direction in FIG. 1.

The ink jet head 3 is mounted on the carriage 2. The ink-jet head 3 has a flow-path unit 13 and an actuator 14. The flow-path unit 13 has a lower surface as a nozzle surface 13*a* in which a plurality of nozzles 10 are formed. There are formed, in the flow-path unit 13, ink flow passages including the nozzles. The nozzles 10 are arranged in a conveyance direction orthogonal to the scanning direction, so as to form, in the nozzle surface 13*a*, four nozzle rows 9 arranged in the scanning direction. Ink of one color is ejected from the nozzles 10 of one nozzle row 9. Specifically, black ink, yellow ink, cyan ink, and magenta ink are ejected from the respective nozzle rows 9 in this order from the right in the scanning direction. The actuator 14 gives ejection energy individually to the ink in the nozzles 10. For instance, the actuator 14 may be configured to give a pressure to the ink by changing a volume of a pressure chamber that communicates with the corresponding nozzle 10 or may be configured to give a pressure to the ink by generating air bubbles in the pressure chamber by heating. The structure of the actuator 14 is known in the art, and its detailed explanation is dispensed with.

The ink-jet head 3 is connected to four tubes 31 via a sub tank (not shown) or the like. The four tubes 31 are connected respectively to four ink cartridges 32 which are arranged in the scanning direction at a front right end portion of the printer 1. The four ink cartridges 32 respectively store the black ink, the yellow ink, the cyan ink, and the magenta ink in this order from the right. The ink of the four different colors stored in the respective four ink cartridges 32 is supplied to the ink-jet head 3 via the respective four tubes 31, etc.

The platen 4 is disposed under the ink-jet head 3 so as to be opposed to the nozzle surface 13*a* when printing is performed. The platen 4 extends over an entire length of a recording sheet P in the scanning direction and is configured to support the recording sheet P from below. The conveyance rollers 5, 6 are respectively disposed upstream and downstream of the platen 4 in the conveyance direction. The conveyance rollers 5, 6 are connected to a conveyance motor 57 (FIG. 2) via a gear (not shown). When the conveyance motor 57 is driven, the conveyance rollers 5, 6 rotate so as to convey the recording sheet P in the conveyance direction.

Each time when the conveyance rollers 5, 6 convey the recording sheet P by a particular distance, the carriage 2 is moved in the scanning direction. During this movement of the carriage 2, the ink is ejected from the nozzles 10 of the ink-jet head 3, so that printing is performed on the recording sheet P.

The flushing foam 7 (as one example of "liquid receiver") is formed of a material capable of absorbing ink, such as a sponge. The flushing foam 7 is located to the left of the platen 4 in the scanning direction. In the printer 1, the carriage 2 is movable by control of a controller 50 (which will be described) to a flushing position (as one example of "second opposed position") at which the nozzle surface 13*a* is opposed to the flushing foam 7. In a state in which the carriage 2 is located at the flushing position, the actuator 14 is driven to permit the ink to be ejected from the nozzles 10, whereby a flushing for discharging thickened ink in the nozzle 10 is performed.

Maintenance Unit

The maintenance unit 8 includes a cap 21, a switching unit 22, a suction pump 23, and a waste-liquid tank 24.

The cap 21 is located to the right of the platen 4 in the scanning direction. In the printer 1, the carriage 2 is movable to a maintenance position (as one example of "first opposed position") at which the nozzle surface 13*a* is opposed to the cap 21. The cap 21 includes a cap portion 21*a* and a cap portion 21*b* located to the left of the cap portion 21*a*. In a state in which the carriage 2 is located at the maintenance position, the nozzles 10 of the rightmost nozzle row 9 are opposed to the cap portion 21*a*, and the nozzles 10 of the left-side three nozzle rows 9 are opposed to the cap portion 21*b*.

The cap 21 is movable upward and downward by a cap elevating and lowering device 58 (FIG. 2) (as one example of "cap moving device" and "switcher"), namely, movable in an intersecting direction that intersects the nozzle surface 13*a*. When the cap 21 is moved upward in a state in which the carriage 2 is located at the maintenance position, the cap 21 comes into close contact with the nozzle surface 13*a*, so that the nozzles 10 are covered by the cap 21. Specifically, the nozzles 10 of the rightmost nozzle row 9 are covered by the cap portion 21*a* while the nozzles 10 of the left-side three nozzle rows 9 are covered by the cap portion 21*b*. (This state will be hereinafter referred to as "capping state" where appropriate.) Thus, the cap elevating and lowering device 58 is configured to move the cap 21 upward and downward such that the cap 21 is located at a capping position to establish the capping state and an uncapping position which is lower than the capping position.

While the cap 21 comes into close contact with the nozzle surface 13*a* to cover the nozzles 10 in the present embodiment, the cap 21 may cover the nozzles 10 in other wary. For instance, the flow-path unit 13 may include a frame disposed around the nozzle surface 13*a* to protect the nozzles 10, and the cap 21 may come into close contact with the frame to cover the nozzles 10.

The switching unit 22 is connected to the cap portions 21*a*, 21*b* via tubes 29*a*, 29*b*. The switching unit 22 is connected to the suction pump 23 via a tube 29*c*. The switching unit 22 is configured to selectively connect one of the cap portions 21*a*, 21*b* to the suction pump 23. The suction pump 23 is a tube pump, for instance. The suction pump 23 is connected, on one side thereof remote from the switching unit 22, to the waste-liquid tank 24.

When the suction pump 23 is driven in the capping state by control of the controller 50 with the cap portion 21*a* and the suction pump 23 connected to the switching unit 22, the black ink is discharged from the flow-path unit 13 through the nozzles 10 of the rightmost nozzle row 9. This discharge will be hereinafter referred to as "suction purging for the black ink". When the suction pump 23 is driven in the capping state with the cap portion 21*b* and the suction pump 23 connected to the switching unit 22, the yellow ink, the cyan ink, and the magenta ink (i.e., color ink) are discharged from the flow-path unit 13 through the nozzles of the left-side three nozzle rows 9. This discharge will be hereinafter referred to as "suction purging for the color ink". The ink discharged by the suction purging is stored in the waste-liquid tank 24.

Electrical Configuration of Printer

Figure 2:
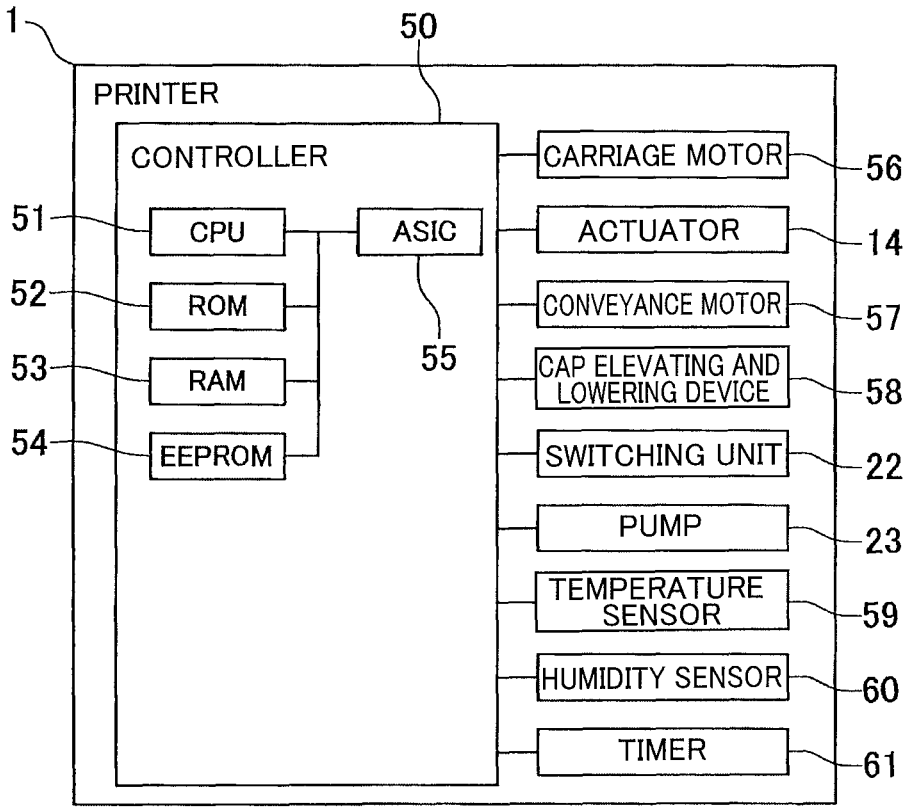
FIG. 2 is a block diagram showing an electrical configuration of the printer according to the first embodiment.

There will be next explained an electrical configuration of the printer 1. Operations of the printer 1 are controlled by the controller 50. As shown in FIG. 2, the controller 50 includes a central processing unit (CPU) 51, a read only memory (ROM) 52, a random access memory (RAM) 53, an electrically erasable programmable read only memory (EEPROM) 54, and an application specific integrated circuit (ASIC) 55. The controller 50 controls operations of the carriage motor 56, the actuator 14, the conveyance motor 57, the cap elevating and lowering device 58, the switching unit 22, and the suction pump 23, for instance. The printer 1 includes a temperature sensor 59 for detecting an ambient temperature S (hereinafter simply referred to as "temperature S" where appropriate) and a humidity sensor 60 for detecting ambient humidity M (hereinafter simply referred to as "humidity M" where appropriate). The controller 50 stores, in the RAM 53, the temperature S based on the detection result of the temperature sensor 59 and the humidity M based on the detection result of the humidity sensor 60. The printer 1 includes a timer 61. The timer 61 is activated when a power-source plug of the printer 1 is connected to or inserted into a receptacle for receiving the electric power. The timer 61 measures a length of time that elapses after being reset, as explained below. The controller 50 obtains, based on the length of time measured by the timer 61, a length of time Tc of the capping state and a length of time Tu of the uncapping state. In the present embodiment, a combination of the ROM 52, the RAM 53, and the EEPROM 54 is one example of "storage".

FIG. 2 illustrates the single CPU 51. The controller 50 may include the single CPU 51 that executes processings solely or may include a plurality of the CPUs 51 that share execution of the processings. Likewise, FIG. 2 illustrates the single ASIC 55. The controller 50 may include the single ASIC 55 that executes processings solely or may include a plurality of the ASICs 55 that share execution of the processings.

In the present printer 1, the cap is placed in the capping state during standby, thereby preventing an increase in an evaporation rate of the ink in the nozzles 10 (hereinafter referred to as "nozzle evaporation rate" where appropriate) due to evaporation of water in the ink in the nozzles 10. In printing, the controller 50 controls the cap elevating and lowering device 58 to lower the cap 21 and controls the carriage motor 56 to move the carriage 2 to the flushing position. The controller 50 then controls the actuator 14 for performing the flushing (pre-printing flushing). After the pre-printing flushing, the controller 50 controls the carriage motor 56 to move the carriage 2 in the scanning direction at a position at which the nozzle surface 13*a* is opposed to the recording sheet P and controls the actuator to eject the ink from the nozzles 10 for printing. After completion of printing, the controller 50 controls the carriage motor 56 to move the carriage 2 to the maintenance position and controls the cap elevating and lowering device 58 to elevate the cap 21, so that the state of the cap 21 is returned to the capping state.

In the present printer 1, the controller 50 regularly (e.g., every one hour) judges a degree of viscosity of the ink in the nozzles 10 and performs, as needed, a regular maintenance processing in which the flushing or the suction purging is performed.

After the suction purging, the ink remains in the cap portions 21*a*, 21*b* to some extent. In a state, such as during printing, in which the nozzles 10 are not covered by the cap 21 (hereinafter referred to as "uncapping state" where appropriate), water in the ink that remains in the cap portions 21*a*, 21*b* (as one example of "remaining liquid") evaporates, and an evaporation rate of the ink in the cap portions 21*a*, 21*b* (hereinafter referred to as "cap evaporation rate" where appropriate) increases. Further, with an increase in the length of time of the uncapping state, an increase in the cap evaporation rate proceeds.

Meanwhile, ink generally contains a humectant. When the cap 21 is placed in the capping state in a situation in which the cap evaporation rate is high, the humectant of the ink in the cap portions 21*a*, 21*b* absorbs water of the ink in the nozzles 10, so that water of the ink in the nozzles 10 moves to the ink in the cap portions 21*a*, 21*b*. As a result, the nozzle evaporation rate is increased, and the ink in the nozzles 10 becomes thickened. In this instance, with an increase in the cap evaporation rate, the movement of water is more likely to proceed, in other words, the nozzle evaporation rate is more likely to increase. Further, with an increase in the length of time of the capping state, the nozzle evaporation rate is more likely to increase and the cap evaporation rate is more likely to decrease. Thus, the degree of viscosity of the ink in the nozzles 10 changes depending upon the cap evaporation rate.

In the first embodiment, therefore, there are made, based on a cap parameter Ec corresponding to the cap evaporation rate, a determination of a discharge amount of the ink from the nozzles 10 in the pre-printing flushing, a determination of a discharge amount of the ink from the nozzles 10 in the suction purging before printing, a determination as to whether the flushing in the regular maintenance is to be performed, a determination as to whether the suction purging in the regular maintenance is to be performed, a determination of a discharge amount of the ink in the flushing in the regular maintenance, and a determination of a discharge amount of the ink in the suction purging in the regular maintenance. The value of the cap parameter Ec is stored in the RAM 53.

The cap parameter Ec for the black ink (corresponding to the nozzles 10 of the rightmost nozzle row 9 and the cap portion 21*a*) and the cap parameter Ec for the three different colors of ink (corresponding to the nozzles 10 of the left-side three nozzle rows 9 and the cap portion 21*b*) are individually stored in the RAM 53. The determinations described above are made individually for the black ink and the three different colors of ink (color ink). The processings explained below are, however, similar between the black ink and the color ink and will be collectively explained hereafter.

A method of calculating the cap parameter Ec will be explained. The controller 50 permits the suction purging described above to be performed when the printer 1 is turned on for the first time, for instance, and resets the value of the cap parameter Ec to a predetermined initial value Ec0. Thereafter, the controller 50 executes processings indicated by the flowcharts of FIGS. 3A and 3B, so as to update the value of the cap parameter Ec stored in the RAM 53 whenever needed. The processings shown in FIGS. 3A and 3B are executed for a time period during which the power-source plug of the printer 1 is connected to or inserted into the receptacle (not shown).

Figure 3A:
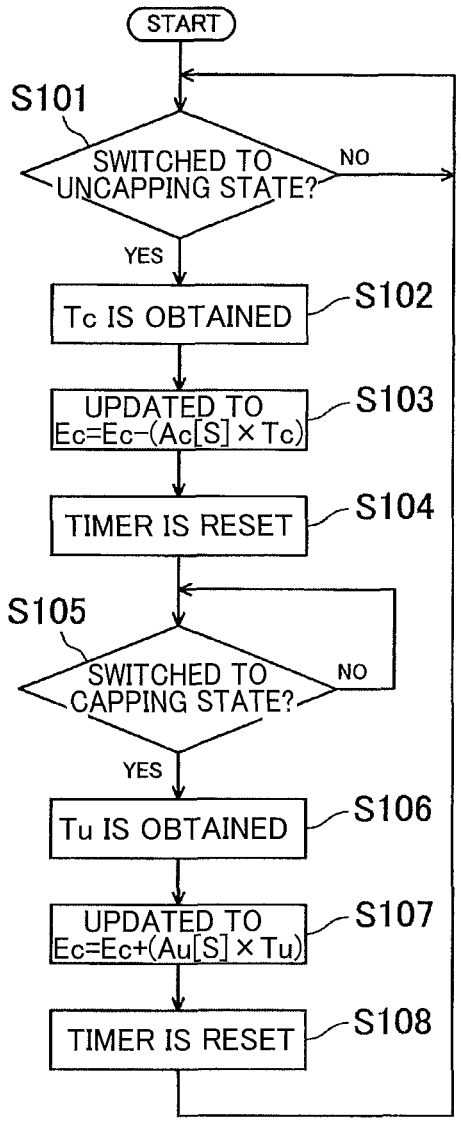
FIG. 3A is a flowchart showing a processing for calculating a cap parameter in the first embodiment.
Figure 3B:
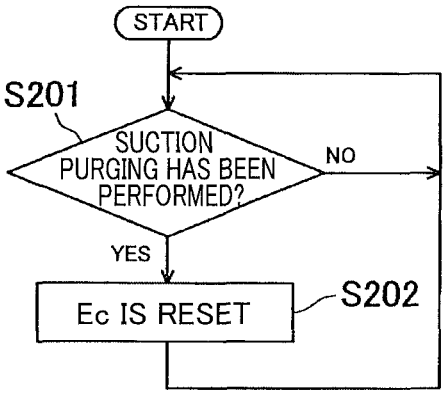
FIG. 3B is a flowchart showing a flow of a processing for resetting the cap parameter when a suction purging is performed, in the first embodiment.

The processing shown in FIG. 3A will be first explained. The controller 50 waits until the state of the cap 21 is switched from the capping state to the uncapping state (S101:NO). When the state of the cap 21 is switched from the capping state to the uncapping state (S101:YES), the controller 50 obtains a length of time measured by the timer 61 as a length of time Tc of the capping state (S102) and updates the value of the cap parameter Ec to a value which is decreased by (Ac[S]×Tc) from a current value (S103). The "Ac[S]" is a coefficient (as one example of "first coefficient") that depends on the temperature S. The coefficient Ac[S] increases with an increase in the temperature S. There is stored, in the ROM 52, information of the coefficient Ac[S] for each temperature S or information for calculating the coefficient Ac[S] in accordance with the temperature S.

Subsequently, the controller 50 resets the timer 61 (S104) and waits until the state of the cap 21 is switched from the uncapping state to the capping state (S105:NO). When the state of the cap 21 is switched from the uncapping state to the capping state (S105:YES), the controller 50 obtains a length of time measured by the timer 61 as a length of time Tu of the uncapping state (S106) and updates the value of the cap parameter Ec to a value which is increased by (Au[S]×Tu) from a current value (S107). The "Au[S]" is a coefficient (as one example of "second coefficient") that depends on the temperature S. The coefficient Au[S] increases with an increase in the temperature S. There is stored, in the ROM 52, information of the coefficient Au[S] for each temperature S or information for calculating the coefficient Au[S] in accordance with the temperature S. Thereafter, the controller 50 resets the timer 61 (S107), and the control flow goes back to S101.

The value of the cap parameter Ec calculated according to the processing of FIG. 3A is as follows. A difference between: a sum of values obtained by multiplying the length of time Tc of the capping state by the coefficient Ac[S] each time when the capping state is switched to the uncapping state; and a sum of values obtained by multiplying the length of time Tu of the uncapping state by the coefficient Au[S] each time when the uncapping state is switched to the capping state is subtracted from the initial value Ec0 of the cap parameter. The value obtained by the subtraction corresponds to the value of the cap parameter Ec calculated according to the processing of FIG. 3A. It is noted that mathematical expressions (as one example of "cap-parameter calculating information") for updating the value of the cap parameter Ec at S103, S107 are stored in the ROM 52 in advance, for example. It is further noted that the processing for updating the value of the cap parameter Ec at S103, S107 is one example of a processing for calculating the cap parameter.

The processing shown in in FIG. 3B will be next explained. The controller 50 waits until the suction purging is performed (S201:NO). When the suction purging is performed (S201:YES), the controller 50 resets the value of the cap parameter Ec to the initial value Ec0 (S202), and the control flow goes back to S201.

The value of the cap parameter Ec calculated according to the processings shown in FIGS. 3A and 3B decreases with an increase in the length of time Tc of the capping state after the most recently performed suction purging (the last purging) and increases with an increase in the length of time Tu of the uncapping state after the most recently performed suction purging (the last purging). Thus, the calculated cap parameter Ec is a value in which is considered a decrease in the cap evaporation rate in accordance with the length of time Tc of the capping state after the most recently performed suction purging, namely, in which is considered the amount of water that moves from the ink in the nozzles 10 to the ink in the cap portions 21*a*, 21*b*, which amount changes in accordance with the length of time Tc of the capping state. Further, the calculated cap parameter Ec is a value in which is considered an increase in the cap evaporation rate in accordance with the length of time Tu of the uncapping state after the most recently performed suction purging, namely, in which is considered the amount of water that evaporates from the ink in the cap portions 21*a*, 21*b*, which amount changes in accordance with the length of time Tu of the uncapping state. Consequently, the calculated cap parameter Ec accurately corresponds to an actual cap evaporation rate.

There will be next explained a method of determining the discharge amount of the ink in the pre-printing flushing based on the cap parameter Ec. In the first embodiment, there is stored, in the EEPROM 54, a table shown in FIG. 4A. The table of FIG. 4A represents a relationship between: cap parameter Ec and length of time Tc1 of the capping state immediately before the pre-printing flushing (as one example of "the most recently measured length of time of the capping state"); and discharge amount (flushing amount) of the ink from the nozzles 10 in the pre-printing flushing. In the table of FIG. 4A, "F111-F113", "F121-F123", and "F131-F133" indicate the flushing amount. In the pre-printing flushing, the ink is discharged by an amount corresponding to the flushing amount determined based on the table of FIG. 4A. In FIG. 4A, Ec11-Ec13 have the following relationship: Ec11<Ec12<Ec13, and T11-T13 have the following relationship: T11<T12<T13. Further, F111-F113, F121-F123, F131-F133 have the following relationships: F111<F112<F113, F121<F122<F123, F131<F132<F133, F111<F121<F131, F112<F122<F132, F113<F123<F133. That is, the flushing amount in the pre-printing flushing is increased with an increase in the value of the cap parameter Ec and with an increase in the length of time Tc1 of the capping state. The flushing amount stored in the table of FIG. 4A may be the discharge amount of the ink per se or may be another value corresponding to the discharge amount of the ink, such as the number of drivings of the actuator 14 in the flushing.

There will be next explained a method of determining as to whether the flushing or the suction purging is to be performed in the regular maintenance and determining the discharge amount of the ink in the flushing and the suction purging, based on the cap parameter Ec. In the first embodiment, there is stored, in the EEPROM 54, a table shown in FIG. 4B. The table of FIG. 4B represents a relationship between: cap parameter Ec and length of time Tc2 of the capping state immediately before the regular maintenance (as one example of "the most recently measured length of time of the capping state"); and discharge amount of the ink in the regular maintenance, etc. In the table of FIG. 4B, "no discharge" means that neither the flushing nor the suction purging is performed, "F213-F225", "F222-F225", and "F231-F223" indicate the discharge amount of the ink in the flushing (flushing amount), and "Pg1-Pg3" indicate the discharge amount of the ink in the suction purging (purging amount).

In FIG. 4B, F213-F215, F222-F225, F231-F233 have the following relationships: F213<F214<F215, F222<F223<F224<F225, F231<F232<F233, F222<F232, F213<F223<F233, F214<F224. That is, when the flushing is performed in the regular maintenance, the flushing amount is increased with an increase in the value of the cap parameter Ec and with an increase in the length of time Tc2 of the capping state. It is noted that the flushing amount stored in the table of FIG. 4B may be the discharge amount of the ink per se or may be another value corresponding to the discharge amount of the ink, such as the number of drivings of the actuator 14 in the flushing.

In FIG. 4B, Pg1-Pg3 have the following relationships: Pg1<Pg3, Pg2<Pg3. That is, when the suction purging is performed in the regular maintenance, the purging amount is increased with an increase in the value of the cap parameter Ec and with an increase in the length of time Tc2 of the capping state. All of the "Pg1-Pg3" are larger than the discharge amount of the ink in the flushing. It is noted that the purging amount stored in the table of FIG. 4B may be the discharge amount of the ink per se or may be another value corresponding to the discharge amount of the ink, such as the number of rotations or the driving time of the suction pump in the suction purging.

In the case where the calculated value of the cap parameter Ec largely varies with respect to a value that corresponds to an actual cap evaporation rate, it is needed to discharge, in the flushing or the suction purging, the ink more than necessary with the large variation taken into account. In the first embodiment, in contrast, the calculated value of the cap parameter Ec accurately corresponds to the actual cap evaporation rate as described above. That is, the calculated value of the cap parameter Ec has a small variation with respect to the value that corresponds to the actual cap evaporation rate. Thus, when the flushing or the suction purging is performed in accordance with the calculated cap parameter Ec, the ink need not be discharged more than necessary, making it possible to minimize the discharge amount of the ink.

In the uncapping state, water in the ink in the cap portions 21*a*, 21*b* is more likely to evaporate with an increase in the temperature S, and accordingly the cap evaporation rate easily increases. In the capping state, the movement of water described above tends to be accelerated with an increase in the temperature S. Thus, the nozzle evaporation rate tends to readily increase and the cap evaporation rate tends to readily decrease. In the first embodiment, therefore, the coefficient Ac[S] to be multiplied by the length of time Tc of the capping state and the coefficient Au[S] to be multiplied by the length of time Tu of the uncapping state, which are used in calculation of the cap parameter Ec, are configured to be increased with an increase in the temperature S. With this configuration, it is possible to accurately calculate the cap parameter Ec in accordance with the temperature S in the capping state and the uncapping state.

In the first embodiment, the processing for performing the pre-printing flushing and the processing for performing the regular maintenance, in accordance with the cap parameter Ec, are one example of a liquid discharge processing.

Second Embodiment

Next, there will be explained a second embodiment. While the second embodiment relates to the printer 1 according to the first embodiment, the second embodiment differs from the first embodiment in the control by the controller 50. Hereinafter, the control of the controller 50 will be mainly explained.

As explained in the first embodiment, in the uncapping state, water included in the ink in the cap portions 21*a*, 21*b* evaporates, and the cap evaporation rate is accordingly increased. Further, with an increase in the length of time of the uncapping state, evaporation of water included in the ink in the cap portions 21*a*, 21*b* proceeds, namely, an increase in the cap evaporation rate is accelerated. In the capping state, water included in the ink in the nozzles 10 moves to the ink in the cap portions 21*a*, 21*b*, so that the cap evaporation rate is decreased while the nozzle evaporation rate is increased, namely, the ink in the nozzles 10 becomes thickened. With an increase in the length of time of the capping state, the movement of water described above proceeds, namely, a decrease in the cap evaporation rate and an increase in the nozzle evaporation rate are accelerated.

Here, a case is considered in which thickening of the ink in the nozzles 10, namely, an increase in the viscosity of the ink in the nozzles 10, is avoided by performing the pre-printing flushing, as in the first embodiment, for instance. In this case, if the length of time of the capping state is long and the nozzle evaporation rate is high immediately before a start of printing, the amount of the ink discharged from the nozzles 10 in the pre-printing flushing for avoiding the thickening of the ink in the nozzles 10 is large, namely, the number of drivings of the actuator 14 is large, resulting in an increase in a time required for the pre-printing flushing. This in turn increases a first print out time (FPOT) which is a length of time before the start of printing after input of a print instruction to the printer 1.

In the second embodiment, therefore, the flushing is performed during standby, thereby preventing the nozzle evaporation rate from becoming too much high immediately before the start of printing.

There will be explained a control of the controller 50 for performing the flushing during standby. The following processings (processings in FIGS. 5-7) are individually performed for the black ink (corresponding to the nozzles 10 of the rightmost nozzle row 9 and the cap portion 21*a*) and for the three different colors of ink (corresponding to the nozzle 10 of the left-side three nozzle rows 9 and the cap portion 21*b*). The flow of the control is, however, similar between the black ink and the three different colors of ink (color ink) and will be collectively explained hereafter.

Figure 5:
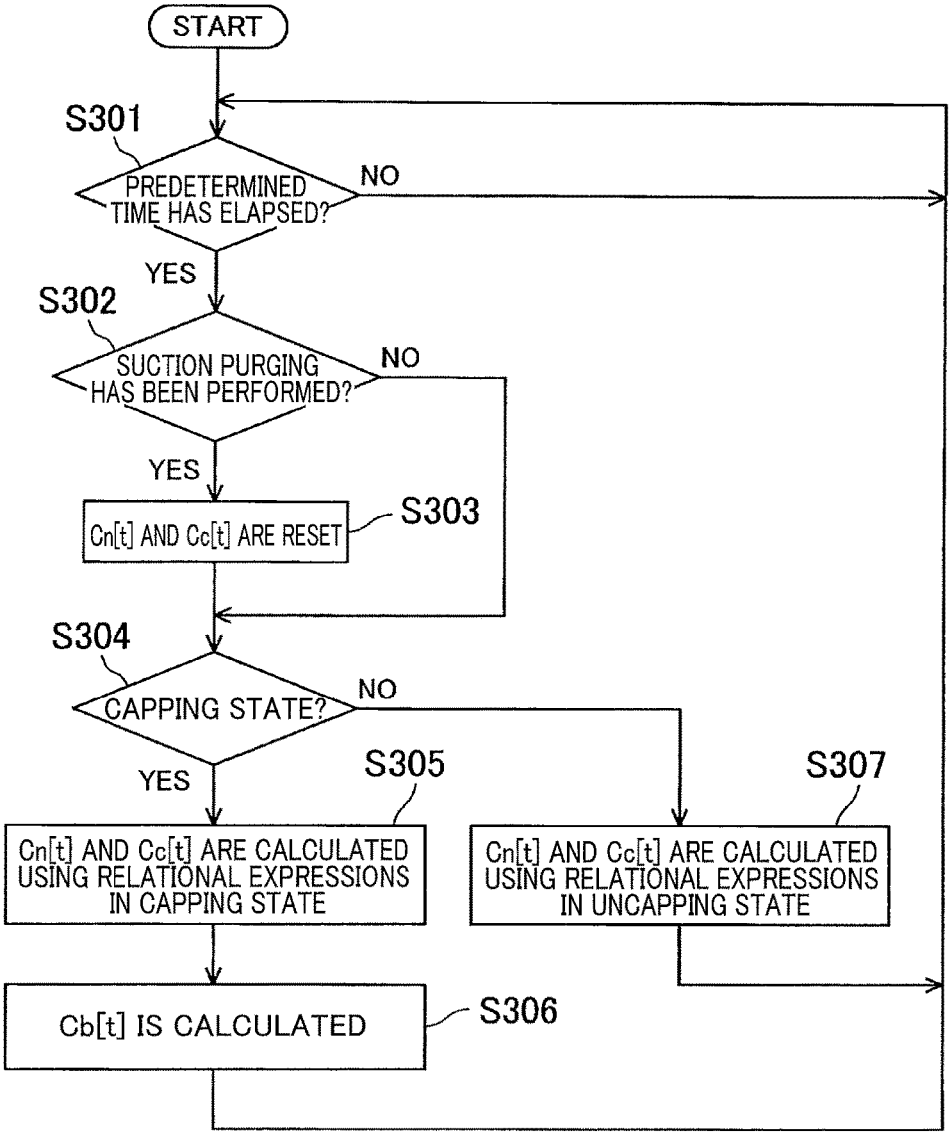
FIG. 5 is a flowchart showing a flow of a processing for calculating a nozzle evaporation rate and a cap evaporation rate in a second embodiment.

The controller 50 executes the processing according to the flowchart of FIG. 5, so as to calculate, for every predetermined time Δt, a current nozzle evaporation rate Cn[t] (at time t) (as one example of "nozzle parameter") and a current cap evaporation rate Cc[t] (at time t) (as one example of "cap parameter"). The processing shown in FIG. 5 is executed for a time period during which the power-source plug of the printer 1 is connected to or inserted into the receptacle (not shown). The flow of the processing shown in FIG. 5 will be specifically explained. The controller 50 waits until a predetermined time elapses (S301:NO). When the predetermined time elapses (S301:YES), the controller resets the nozzle evaporation rate Cn[t] and the cap evaporation rate Cc[t] to respective initial values Cn0, Cc0 (e.g., 0%) (S303) in the case where the suction purging has been performed during standby (S302:YES). The control flow then goes to S304. In the case where the suction purging has not been performed during standby (S302:NO), the control flow goes immediately to S304.

At S304, it is determined whether the state of the cap 21 is the capping state. When the cap 21 is in the capping state (S304:YES), the current nozzle evaporation rate Cn[t] and the current cap evaporation rate Cc[t] are calculated according to the following relational expressions (1) and (2) (S305). The relational expressions (1) and (2) are stored in advance in the ROM 52 of the controller 50.

$$Cn[t]=Cn[t-1]+(Cc[t-1]-Cn[t-1])\times F[S]\times G[Vn]\times\gamma 1 \quad (1)$$

$$Cc[t]=Cc[t-1]+(Cn[t-1]-Cc[t-1])\times F[S]\times G[Vc]\times\gamma 1 \quad (2)$$

Here, Cn[t−1] is an immediately preceding nozzle evaporation rate calculated immediately before, namely, calculated at time [t−1] that precedes the time t by Δt, and Cc[t−1] is an immediately preceding cap evaporation rate calculated immediately before, namely, calculated at time [t−1] that precedes the time t by Δt. Further, F[S], G[Vn], G[Vc], and γ1 are coefficients relating to the movement of water from the ink in the nozzles 10 to the ink in the cap portions 21*a*, 21*b*. The value of the coefficient F[S] is determined based on the temperature S. The value of the coefficient G[Vn] is determined based on a volume of the nozzle 10. The value of the coefficient G[Vc] is determined based on a volume of the cap portion 21*a*, 21*b*. The value of the coefficient γ1 is determined based on a surface area of the nozzle 10, a surface area of the ink in the cap portion 21*a*, 21*b*, a distance between the nozzle 10 and the ink in the cap portion 21*a*, 21*b*, and properties of the ink, for instance.

Subsequently, the controller 50 calculates an equilibrium evaporation rate Cb[t] (as one example of "equilibrium parameter") using the nozzle evaporation rate Cn[t] and the cap evaporation rate Cc[t] calculated at S305, according to the following relational expression (3) (S306). The equilibrium evaporation rate is an evaporation rate at which the nozzle evaporation rate and the cap evaporation rate equilibrate when the capping state is continued. After calculation of the equilibrium evaporation rate Cb[t], the control flow goes back to S101.

$$Cb[t]=(Cn[t]\times Vn[t]+Cc[t]\times Vc[t])/(Vn[t]+Vc[t]) \quad (3)$$

On the other hand, when the state of the cap 21 is the uncapping state such as in printing (S304:NO), the controller 50 calculates the current nozzle evaporation rate Cn[t] and the current cap evaporation rate Cc[t] using the following relational expressions (4) and (5) (S307), and the control flow goes back to S301.

$$Cn[t]=Cn0 \quad (4)$$

$$Cc[t]=Cc[t-1]+(Ca[t-1]-Cc[t-1])\times F[S]\times G[Vc]\times\gamma 2 \quad (5)$$

The relational expressions (4) and (5) are stored in the ROM 52 of the controller 50 in advance. Here, Ca[t−1] is a concentration of water vapor in the atmosphere and is determined based on the temperature S, the humidity M, etc. γ2 is a coefficient in accordance with a relationship between the cap portion 21*a*, 21*b* and the ambient air. By calculating the nozzle evaporation rate Cn[t] according to the relational expression (4), the nozzle evaporation rate Cn[t] stored in the RAM 53 is reset to the initial value Cn0 (the initial value Cn0 corresponding to Cn[t−1] used when the evaporation rates Cc[t], Cn[t] are calculated in the subsequent capping state). Thus, in the second embodiment, when the ink is ejected from the nozzles 10 to the recording sheet P by printing, the nozzle evaporation rate Cn is reset to the initial value Cn0.

The nozzle evaporation rate and the cap evaporation rate at a certain time point are determined mainly based on an immediately preceding nozzle evaporation rate that immediately precedes the nozzle evaporation rate at the certain time point and an immediately preceding cap evaporation rate that immediately precedes the cap evaporation rate at the certain time point. In the second embodiment, therefore, the current evaporation rates Cn[t], Cc[t] are calculated for every predetermined time Δt based on the immediately preceding evaporation rates Cn[t−1], Cc[t−1].

In this instance, in the capping state, the evaporation rates Cn[t], Cc[t] are calculated according to the relational expressions (1) and (2). Thus, the calculated evaporation rates Cn[t], Cc[t] are values in which are considered an increase in the nozzle evaporation rate and a decrease in the cap evaporation rate in accordance with the length of time of the capping state, namely, in which is considered the amount of water that moves from the ink in the nozzles 10 to the ink in the cap portions 21*a*, 21*b*. In the uncapping state, on the other hand, the evaporation rates Cn[t], Cc[t] are calculated according to the relational expressions (4) and (5). Thus, the calculated evaporation rates Cn[t], Cc[t] are accurate values in which is considered an increase in the cap evaporation rate in accordance with the length of time of the uncapping state, namely, in which is considered the amount of water that evaporates from the ink in the cap portions 21*a*, 21*b*. Accordingly, the calculated evaporation rates Cn[t], Cc[t] accurately correspond to respective actual evaporation rates. Further, the equilibrium evaporation rate Cb[t] calculated at S306 also accurately corresponds to an actual equilibrium evaporation rate.

In the second embodiment, information on the relational expressions (1) and (4) stored in the EEPROM 54 is one example of "nozzle-parameter calculating information", and information on the relational expressions (2) and (5) stored in the EEPROM 54 is one example of "cap-parameter calculating information". Further, in the processings at S305 and S307, the processing for calculating the nozzle evaporation rate Cn[t] based on the relational expressions (1) and (4) is one example of a processing for calculating the nozzle parameter, and the processing for calculating the cap evaporation rate Cc[t] based on the relational expressions (2) and (5) is one example of a processing for calculating the cap parameter. Moreover, the processing at S306 is one example of a processing for calculating the equilibrium parameter.

Figure 6:
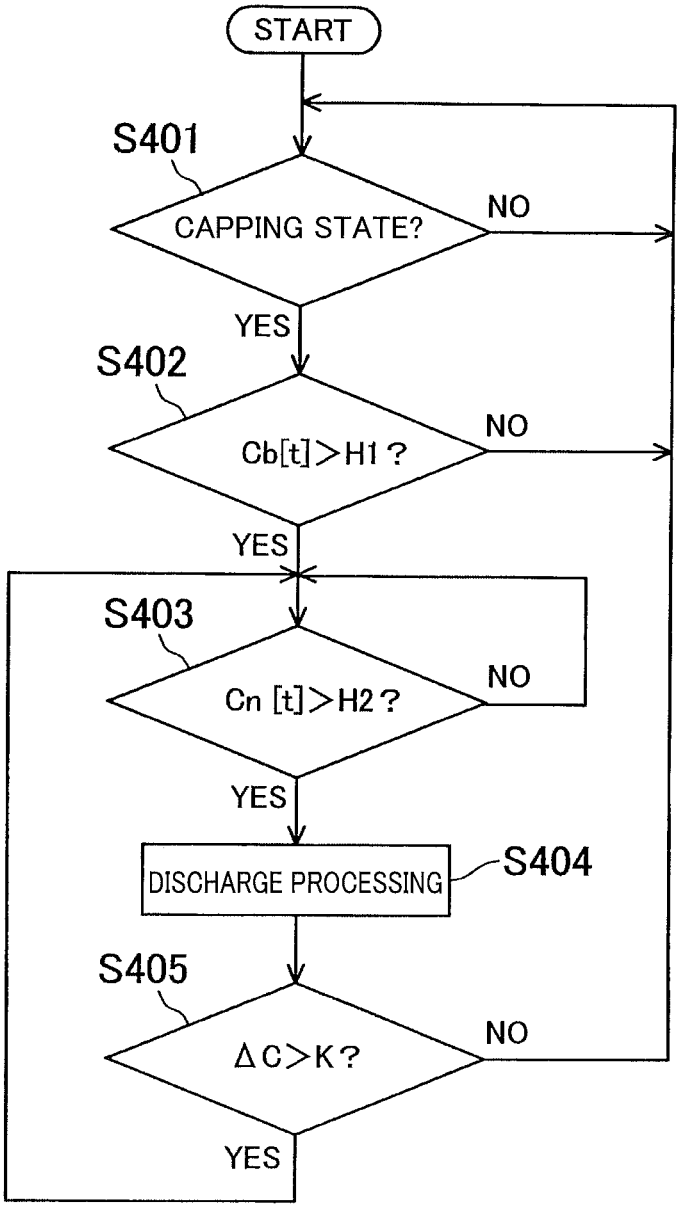
FIG. 6 is a flowchart showing a flow of a processing for performing the flushing in accordance with evaporation rates.

The controller 50 executes a processing according to a flowchart in FIG. 6 based on the nozzle evaporation rate Cn[t], the cap evaporation rate Cc[t], and the equilibrium evaporation rate Cb[t] which are calculated as described above every time when the predetermined time elapses. The processing shown in FIG. 6 is executed for a time period during which the power-source plug of the printer 1 is connected to or inserted into the receptacle (not shown). The flow of the processing shown in FIG. 6 will be specifically explained. When the cap 21 is in the uncapping state, the controller 50 does not execute a processing at S402-S405 which will be explained (S401:NO). When the cap 21 is in the capping state (S401:YES), the controller 50 determines whether the equilibrium evaporation rate Cb is higher than a predetermined first threshold H1 (e.g., about 50%) (S402). When the equilibrium evaporation rate Cb is not higher than the first threshold H1 (S402:NO), the control flow goes back to S401. When the equilibrium evaporation rate Cb is higher than the first threshold H1 (S402:YES), the controller 50 waits until the nozzle evaporation rate Cn[t] becomes higher than a predetermined second threshold H2 (e.g., about 20%) (S403:NO) as a result of the movement of water from the ink in the nozzles 10 to the ink in the cap portions 21*a*, 21*b* in the capping state. When the nozzle evaporation rate Cn[t] becomes higher than the second threshold H2 (S404:YES), the discharge processing (liquid discharge processing) is performed (S404).

Figure 7:
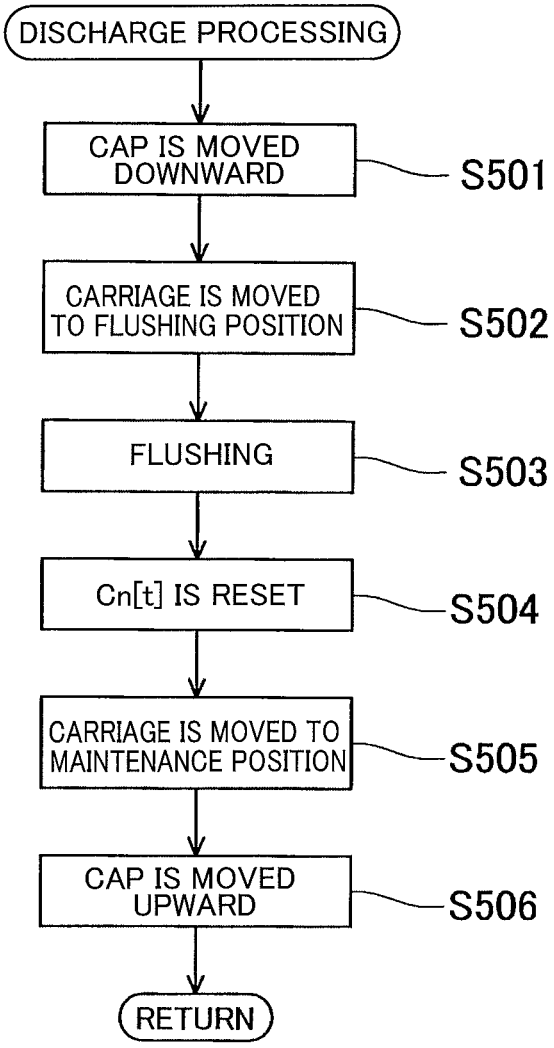
FIG. 7 is a flowchart showing a flow of a discharge processing (flushing) in FIG. 6.

As shown in FIG. 7, in the discharge processing at S404, the controller 50 initially controls the cap elevating and lowering device 58 to move the cap 21 downward (S501). The controller 50 subsequently controls the carriage motor 56 to move the carriage 2 to the flushing position (S502). The controller 50 then controls the actuator 14 to perform the flushing (S503). The controller 50 resets the nozzle evaporation rate Cn[t] stored in the RAM 53 to the initial value Cn0 (S504). Thus, in the second embodiment, when the flushing is performed, the nozzle evaporation rate Cn is reset to the initial value Cn0. Subsequently, the controller 50 controls the carriage motor 56 to move the carriage 2 to the maintenance position (S505) and then controls the cap elevating and lowering device 58 to move the cap 21 upward (S506), whereby the state of the cap 21 is returned to the capping state.

Going back to FIG. 6, after the discharge processing at S404, the control flow goes back to S403 in the case where a difference ΔC[t] (=|Cn[t]−Cc[t]|) between the nozzle evaporation rate Cn[t] and the cap evaporation rate Cc[t] is larger than a predetermined value K (e.g., K=H2) (S405: YES). On the other hand, the control flow goes back to S401 in the case where the difference ΔC[t] between the evaporation rates is not larger than the predetermined value K (S405:NO). Thus, in the second embodiment, for a time period during which the difference ΔC[t] between the evaporation rates is larger than the predetermined value K, the discharge processing at S403 is repeated every time when the nozzle evaporation rate Cn[t] becomes higher than the second threshold H2. When the difference ΔC[t] between the evaporation rates becomes equal to or smaller than the predetermined value K, the repetition of the discharge processing is stopped.

Figure 8:
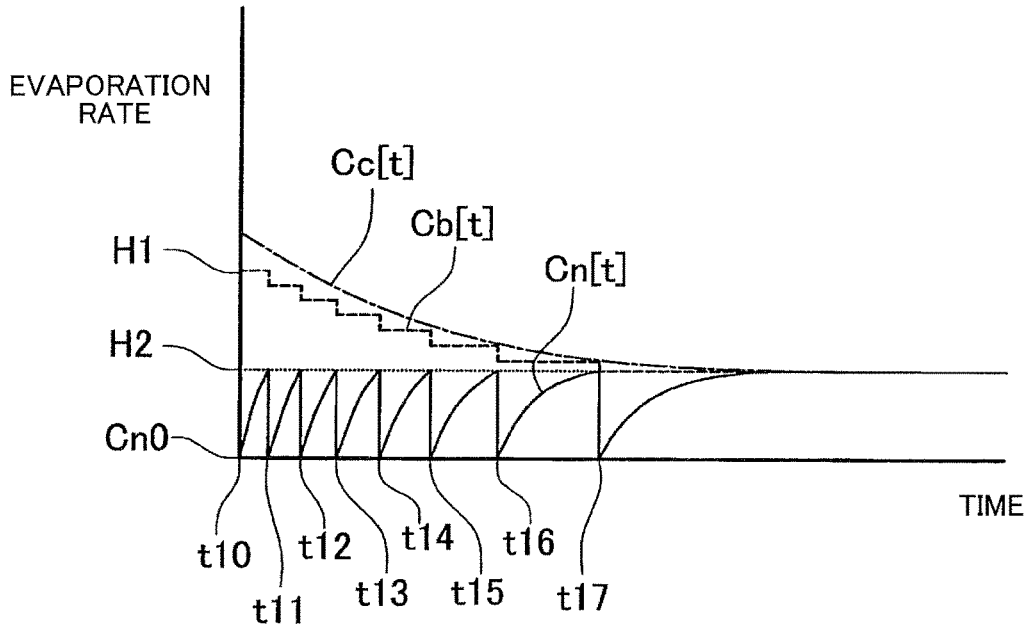
FIG. 8 is a view showing one example of changes in the evaporation rates with time when the processing in FIG. 6 is performed.

FIG. 8 shows one example of changes, with time, of the nozzle evaporation rate and the cap evaporation rate after the equilibrium evaporation rate Cb[t] becomes larger than the first threshold H1. In FIG. 8, the solid line indicates the nozzle evaporation rate Cn[t], the long dashed short dashed line indicates the cap evaporation rate Cc[t], and the dashed line indicates the equilibrium evaporation rate Cb[t]. In FIG. 8, time t10 indicates timing at which the equilibrium evaporation rate Cb[t] becomes larger than the first threshold H1 and the nozzle evaporation rate Cn[t] becomes larger than the second threshold H2. Further, each of times t11-t17 is timing at which the discharge processing is performed.

When the flushing is performed in the discharge processing, the ink in the nozzles 10 is replaced, so that the nozzle evaporation rate is decreased. When the cap 21 is thereafter placed in the capping state, the cap evaporation rate is decreased as shown in FIG. 8 as a result of the movement of water from the ink in the nozzles 10 to the ink in the cap portions 21*a*, 21*b*. In this instance, the nozzle evaporation rate is increased. However, since the flushing has been performed, a sum of the amount of water in the ink in the nozzles 10 and the amount of water in the ink in the cap portion 21*a*, 21*b* is higher than that before performing the flushing. Accordingly, the nozzle evaporation rate and the cap evaporation rate are not increased beyond those before performing the flushing. Thus, the nozzle evaporation rate and the cap evaporation rate can be decreased by performing the discharge processing.

With an increase in the length of time of the capping state, the nozzle evaporation rate and the cap evaporation rate finally reach the equilibrium evaporation rate. In the second embodiment, therefore, the equilibrium evaporation rate Cb[t] is calculated in the capping state, and the discharge processing is performed when the equilibrium evaporation rate Cb[t] becomes larger than the first threshold H1. Thus, in an instance where the nozzle evaporation rate is expected to become high, both of the nozzle evaporation rate and the cap evaporation rate can be decreased by performing the discharge processing.

In the second embodiment, the ink is ejected, in the flushing, to the flushing foam 7 disposed outside the cap 21, and the cap evaporation rate is decreased by the movement of water from the ink in the nozzles 10 to the ink in the cap portions 21*a*, 21*b*, which movement occurs thereafter in the capping state. It takes a certain degree of time for decreasing the cap evaporation rate by such a movement of water. Consequently, it is of great significance to predict the future nozzle evaporation rate and cap evaporation rate by calculating the equilibrium evaporation rate Cb[t] and to perform the flushing.

When the equilibrium evaporation rate Cb[t] becomes larger than the first threshold H1, the discharge processing is repeated each time when the nozzle evaporation rate Cn[t] becomes larger than the second threshold H2. With this configuration, the capping state is maintained after the discharge processing until the movement of water described above sufficiently proceeds, and next discharge processing can be performed thereafter. As shown in FIG. 8, each time when the discharge processing is performed, the cap evaporation rate is gradually decreased owing to the movement of water described above, so that the nozzle evaporation rate and the cap evaporation rate can be decreased by repeating the discharge processing. In this instance, by setting the second threshold H2 at a higher level, it is possible to reduce the number of repetitions of the discharge processing in a time period before the difference ΔC[t] between the evaporation rates becomes equal to or smaller than the predetermined value K.

A case is considered in which the calculated evaporation rates Cn[t], Cc[t], Cb[t] largely vary with respect to the respective actual evaporation rates, unlike the second embodiment. In this case, in consideration of the variations of the calculated evaporation rates, the frequency at which the processings at S403-S405 are executed is increased more than necessary by setting the first threshold H1 at a lower level or the number of repetitions of the discharge processing is increased more than necessary by setting the predetermined value K at a lower level, so that the discharge amount of the ink becomes larger than necessary.

In the second embodiment, in contrast, the calculated evaporation rates Cn[t], Cc [t], Cb[t] accurately correspond to the respective actual evaporation rates. That is, the calculated evaporation rates Cn[t], Cc[t], Cb[t] have small variations with respect to the respective actual evaporation rates. Thus, the frequency at which the processings at S403-S405 are executed need not be increased more than necessary by setting the first threshold H1 at a lower level or the number of repetitions of the discharge processing need not be increased more than necessary by setting the predetermined value K at a lower level, so that the discharge amount of the ink can be made as small as possible.

The relational expressions (1), (2), and (5) include the coefficient F(S) that is determined in accordance with the temperature S. That is, the evaporation rates Cn[t], Cc[t] are calculated based on the temperature S in the second embodiment. It is consequently possible to more accurately calculate the evaporation rates Cn[t], Cc[t] in accordance with the temperature S.

When the difference ΔC between the evaporation rates becomes smaller, the movement of water described above does not substantially occur. Thus, in the present embodiment, the repetition of the discharge processing is stopped when the difference ΔC between the evaporation rates becomes equal to or smaller than the predetermined value K. With this configuration, the discharge processing is not repeated more than necessary, thereby minimizing the discharge amount of the ink.

When the ink is discharged from the nozzles 10 by the flushing, the ink in the nozzles 10 is replaced, so that the nozzle evaporation rate becomes equal to a certain initial value. Accordingly, in the present embodiment, the nozzle evaporation rate Cn[t] is reset to the initial value Cn0 after the flushing has been performed. Thus, the evaporation rates Cn[t], Cc[t] can be accurately calculated.

Also when the ink is ejected from the nozzles 10 by performing printing, the ink in the nozzles 10 is replaced, so that the nozzle evaporation rate becomes equal to a certain initial value. Accordingly, in the present embodiment, the nozzle evaporation rate Cn[t] is reset to the initial value Cn0 after printing has been performed. Thus, the evaporation rates Cn[t], Cc[t] can be accurately calculated.

In the second embodiment, the evaporation rates Cn[t], Cc[t] are calculated in consideration of the movement of water from the ink in the nozzles 10 to the ink in the cap portions 21*a*, 21*b*. Accordingly, when the discharge processing is repeated as shown in FIG. 8, a change in the nozzle evaporation rate Cn[t] calculated after the discharge processing gradually becomes gentler in the discharge processings that are later performed, resulting in an increase in a length of time required for the nozzle evaporation rate Cn[t] to reach the second threshold H2 after the discharge processing.

Unlike the second embodiment, in an instance where the nozzle evaporation rate is calculated without considering the movement of water from the ink in the nozzles 10 to the ink in the cap portions 21*a*, 21*b*, the length of time required for the calculated nozzle evaporation rate to reach the second threshold after the discharge processing does not change even if the discharge processing is repeatedly performed, namely, the length of time remains equal to that between time t10 to time t11, for instance. Accordingly, in this instance, the frequency at which the discharge processing is performed is inevitably increased, and the discharge amount of the ink is accordingly increased, as compared with the second embodiment. Conversely, in the second embodiment, the evaporation rates Cn[t], Cc[t] are calculated in consideration of the movement of water described above, so that the discharge processing is not performed more than necessary and the discharge amount of the ink is accordingly made as small as possible.

Third Embodiment

There will be next explained a third embodiment. The third embodiment differs from the second embodiment in the processing for calculating the nozzle evaporation rate Cn[t] and the cap evaporation rate Cc[t].

Figure 9:
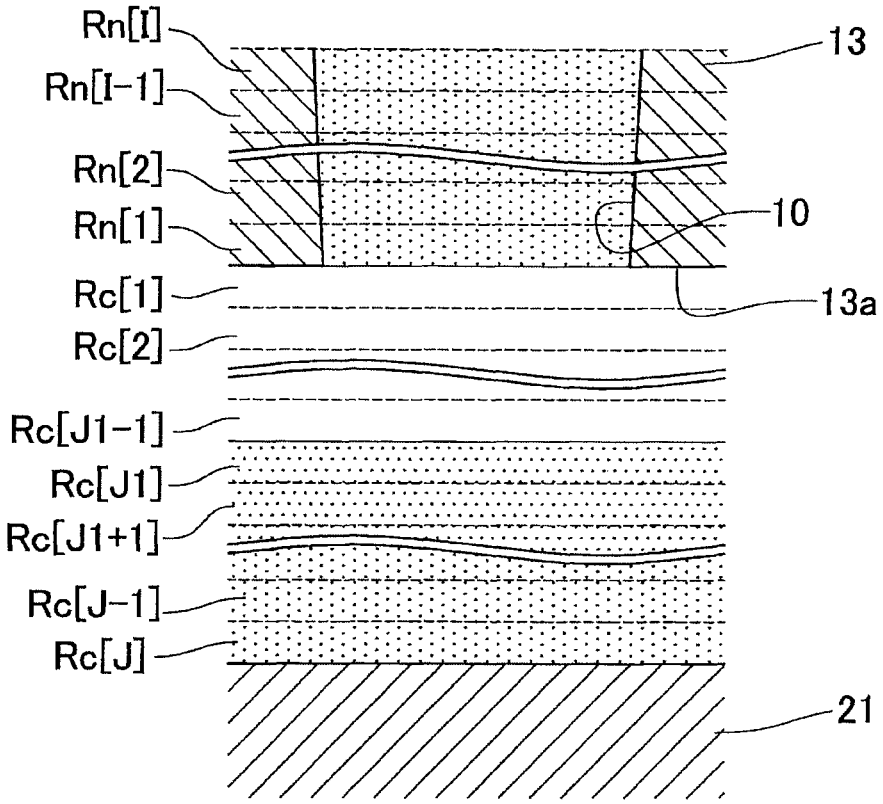
FIG. 9 is a view for explaining nozzle regions and cap regions in a third embodiment.

In the third embodiment, an inside of the nozzle 10 and an inside of the cap portion 21*a*, 21*b* are divided into a plurality of regions arranged in the up-down direction, as shown in FIG. 9. The nozzle evaporation rate Cn[t] and the cap evaporation rate Cc[t] are calculated as explained below in consideration of a movement of water among the regions. The following explanation is made based on an example in which the inside of the nozzle 10 is divided into the number I of nozzle regions Rn[i] (i=1, 2, 3, . . . , I), and the inside of the cap portion 21*a*, 21*b* is divided into the number J of cap regions Rc[j] (j=1, 2, 3, . . . , J). In the example below, the ink is present in the cap regions Rc[j] in which j is equal to or larger than J1 (J1<J), namely, j≥J1 (J1<J), among the number J of the cap regions Rc[j].

Figure 10:
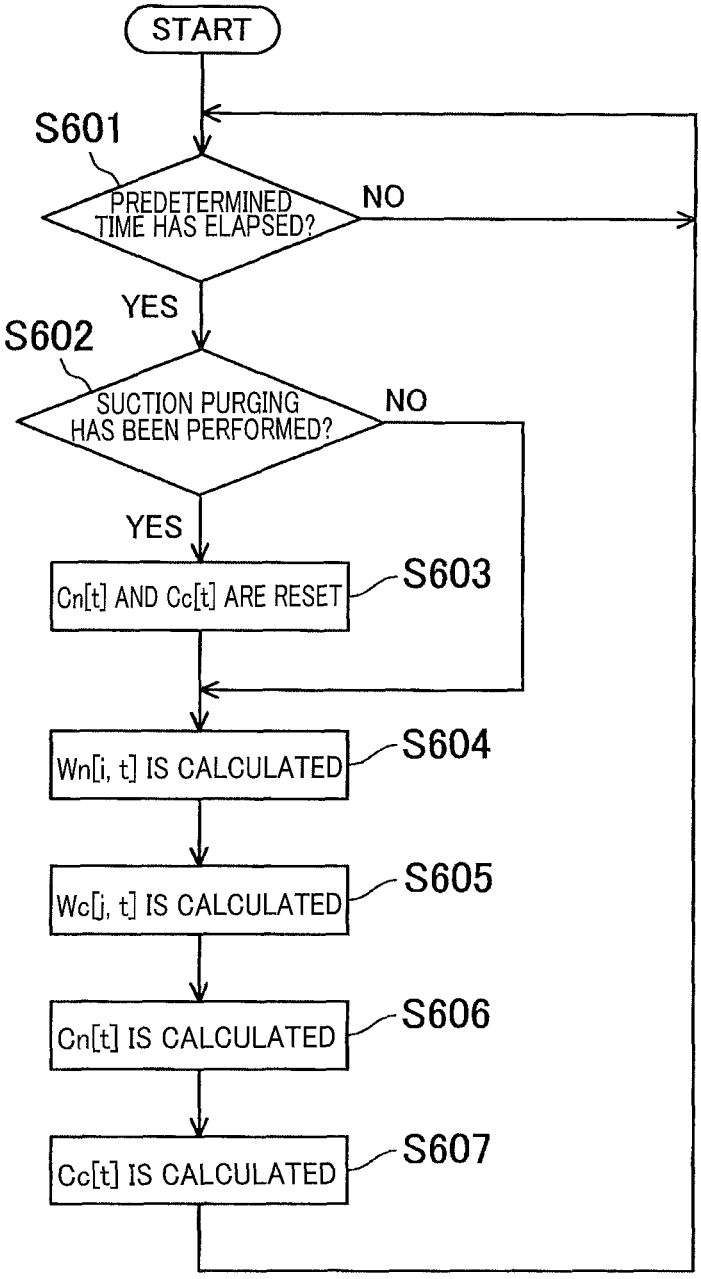
FIG. 10 is a flowchart showing a flow of a processing for calculating the nozzle evaporation rate and the cap evaporation rate in the third embodiment.

In the third embodiment, as shown in FIG. 10, the controller 50 executes processings at S601-S603 similar to those at S301-S303 in the second embodiment. In the case where the suction purging has not been performed during standby (S602:NO) and in the case where the suction purging has been performed (S602:YES) and the processing at S603 has been executed, the control flow goes to S604. At S604, the controller calculates a water weight Wn[i, t] in each nozzle region Rn[i] at a current time point (time t) according to the following relational expression (6).

$$Wn[i,t] = Wn[i,t-1] + \{A[i-1] \times (U[i-1,t-1] - U[i,t-1]) + A[i] \times (U[i+1,t-1] - U[i,t-1])\} \times \Delta t \quad (6)$$

In the relational expression (6), A[i] is a diffusion coefficient between the nozzle region Rn[i+1] and the nozzle region Rn[i] (i=1, 2, 3, . . . ). A value of A[1] in the case where i=1 is a diffusion coefficient between the nozzle region Rn[1] and the cap region Rc[1] in the capping state while it is a diffusion coefficient between the nozzle region Rn[1] and the outside air in the uncapping state.

U[i, t] is a water concentration in the nozzle region Rn[i] at time [t] (i=1, 2, 3, . . . ) and is calculated according to the following relational expression (7). In the relational expression (7), Wa[i, t] is a total weight of the ink in the nozzle region Rn[i] at time [t]. A value of U[1, t] in the case where i=1 is a value in accordance with a water vapor concentration in the nozzle region Rn[1] in the capping state while it is a value in accordance with a water vapor concentration in the outside air in the uncapping state.

$$U[i-1,t-1] = Wn[i-1,t-1]/Wa[i-1,t-1] \quad (7)$$

$$(i=1,2,3,\ldots)$$

The controller 50 subsequently calculates a water weight Wc[j, t] in each cap region Rc[j] according to the following relational expression (8) (S605).

$$Wc[j,t] = Wc[j,t-1] + \{B[j-1] \times (Q[j-1,t-1] - Q[j,t-1]) + B[j] \times (Q[j+1,t-1] - Q[j,t-1])\} \times \Delta t \quad (8)$$

In the relational expression (8), B[j−1] is a diffusion coefficient between the cap region Rc[j] and the cap region Rc[j−1] (in the case where j=2, 3, . . . ). A value of B[0] in the case where j=1 is a diffusion coefficient between the cap region Rc[1] and the nozzle region Rn[1] in the capping state while it is a diffusion coefficient between the nozzle region Rn[1] and the outside air in the uncapping state.

Further, Q[j−1, t−1] is a water vapor concentration in the cap region Rc[j−1] at time [t−1] (in the case where j=2, 3, . . . ) and is calculated according to the following relational expression (9) (in the case where j=2, 3, . . . , J1−1) or according to the following relational expression (10) (in the case where j=J1, J1+1, . . . ).

$$Q[j-1,t-1]=Wc[j-1,t-1]/M/Vc \quad (9)$$

(in the case where $j=2,3,\ldots,J1-1$)

$$Q[j-1,t-1]=X[S]\times Y[Er[j-1]] \quad (10)$$

(in the case where $j=J1,J1+1,J1+2,\ldots$)

In the relational expression (9), M is a molar mass of water, and Vc is a volume of the cap portion 21*a*, 21*b*. In the relational expression (10), X[S] is a saturated vapor concentration at the temperature S. Further, Er[j−1] is an ink evaporation rate in the cap region Rc[j−1], and Y[Er[j−1]] is a relative humidity when the ink evaporation rate is equal to Er[j−1].

The case where j=2, 3, . . . , J1−1 corresponds to the cap region Rc[j] of the cap portion 21*a*, 21*b* in which no ink is present while the case where j=J1, J1+1, J1+2, . . . corresponds to the cap region Rc[j] of the cap portion 21*a*, 21*b* in which the ink is present in liquid form. The case where j=2, 3, . . . J−1 corresponds to the cap region Rc[j] of the cap portion 21*a*, 21*b* in which no ink is present. Further, Q[0, t−1] in the case where j=1 is a value in accordance with a water concentration in the nozzle region Rn[1].

Subsequently, the controller 50 calculates the nozzle evaporation rate Cn[t] at S606 (as one example of a processing for calculating a nozzle parameter) using the water weight W[i,t] in each nozzle region Rn[i] calculated at S604, according to the following relational expression (11). In the relational expression (11), Wn0[i] is an initial value of the water weight in each nozzle region Rn[i], and Wfn[i] is a weight of a nonvolatile component in each nozzle region Rn[i]. The nozzle region Rn[I1] (I1<I) is the nozzle region Rn[i] located in a range farthest from the nozzle surface 13*a*, among the nozzle regions Rn that influence the nozzle evaporation rate Cn[t].

$$Cn(t) = \frac{\sum_{i=1}^{I1} (Wn[i,t] + Wfn[i])}{\sum_{i=1}^{I1} (Wn0[i] + Wfn[i])} \quad (11)$$

The controller 50 subsequently calculates the cap evaporation rate Cc[t] at S607 (as one example of a processing for calculating the cap parameter) using the water weight W[j,t] in each nozzle region Rn[j] calculated at S605, according to the following relational expression (12). In the relational expression (12), Wc0[j] is an initial value of the water weight in each cap region Rc[j], and Wfc[j] is a total weight of the nonvolatile component in the ink in each cap region Rc[j].

$$Cc[t] = \frac{\sum_{i=J1}^{J} (Wc[j,t] + Wfc[j])}{\sum_{i=J1}^{J} (Wc0[j] + Wfc[j])} \quad (12)$$

In the third embodiment, information of the relational expressions (6), (7), and (11) necessary for calculating the nozzle evaporation rate Cn[t] is one example of "nozzle-parameter calculating information". Further, information of the relational expressions (8), (9), (10), and (12) necessary for calculating the cap evaporation rate Cc[t] is one example of "cap-parameter calculating information".

In the third embodiment, there are executed processings similar to those in FIG. 6 of the second embodiment, utilizing the nozzle evaporation rate Cn[t] and the cap evaporation rate Cc[t] calculated as described above.

In the third embodiment, the nozzle evaporation rate and the cap evaporation rate are calculated in consideration of the movement of water among the regions. As compared with the second embodiment, the processings for calculating the nozzle evaporation rate and the cap evaporation rate are complicated, but it is possible to calculate the nozzle evaporation rate and the cap evaporation rate more precisely.

Next, there will be explained modifications of the first through third embodiments.

In the first embodiment, the amount of decrease in the cap parameter Ec when the capping state is switched to the uncapping state is calculated by Ac[S]×Tc, and the amount of increase in the cap parameter Ec when the uncapping state is switched to the capping state is calculated by Au[S]×Tu. Those amounts may be calculated otherwise. For instance, there may be stored, in the EEPROM 54, a table indicating a relationship between: the length of time Tc of the capping state and the temperature S; and the decrease amount of the cap parameter Ec and a table indicating a relationship between: the length of time Tu of the uncapping state and the temperature S; and the increase amount of the cap parameter Ec. The increase amount and the decrease amount of the cap parameter Ec may be determined based on the tables.

In the first embodiment, the amount of decrease in the cap parameter Ec when the capping state is switched to the uncapping state is determined in dependence on the length of time Tc of the capping state and the temperature S, and the amount of increase in the cap parameter Ec when the uncapping state is switched to the capping state is determined in dependence on the length of time Tu of the uncapping state and the temperature S. Those amounts may be determined otherwise. For instance, the change amount of the cap parameter Ec (the decrease amount and the increase amount) may be calculated using a constant coefficient that does not depend on the temperature S, instead of using the coefficients Ac[S], Au[S]. Thus, the change amount of the cap parameter Ec may be determined irrespective of the temperature S.

In the first embodiment, the discharge amount of the ink in the pre-printing flushing is changed depending upon the value of the cap parameter Ec and the most recently measured length of time Tc1 of the capping state. The present disclosure is not limited to this configuration. For instance, when a print instruction is input, the pre-printing flushing may be performed only in an instance where the cap parameter Ec is larger than a predetermined threshold (e.g., Ec12 in FIG. 4A) and the length of time Tc1 is larger than a predetermined threshold (e.g., T12 in FIG. 4A). In other instance, printing may be started without performing the pre-printing flushing.

In the first embodiment, the determination as to whether the flushing and the suction purging in the regular maintenance should be performed, the determination of the flushing amount when the flushing is to be performed, and the determination of the purging amount when the suction purging is to be performed, are made based on the value of the cap parameter Ec and the most recently measured length of time Tc2 of the capping state. The present disclosure is not limited to this configuration. Only the determination as to whether the flushing and the suction purging should be performed in the regular maintenance may be made based on the value of the cap parameter Ec and the length of time Tc2 of the capping state, and the flushing amount and the purging amount may be constant.

While the value of the cap parameter Ec corresponding to a change in the cap evaporation rate is calculated in the first embodiment, the cap evaporation rate per se may be used as the cap parameter.

While the relational expressions (1), (2), and (5) include the coefficient F[S] that depends on the temperature S in the second embodiment, the coefficient F[S] in the relational expressions (1), (2), and (5) may be replaced with a constant coefficient that does not depend on the temperature S.

Figure 11:
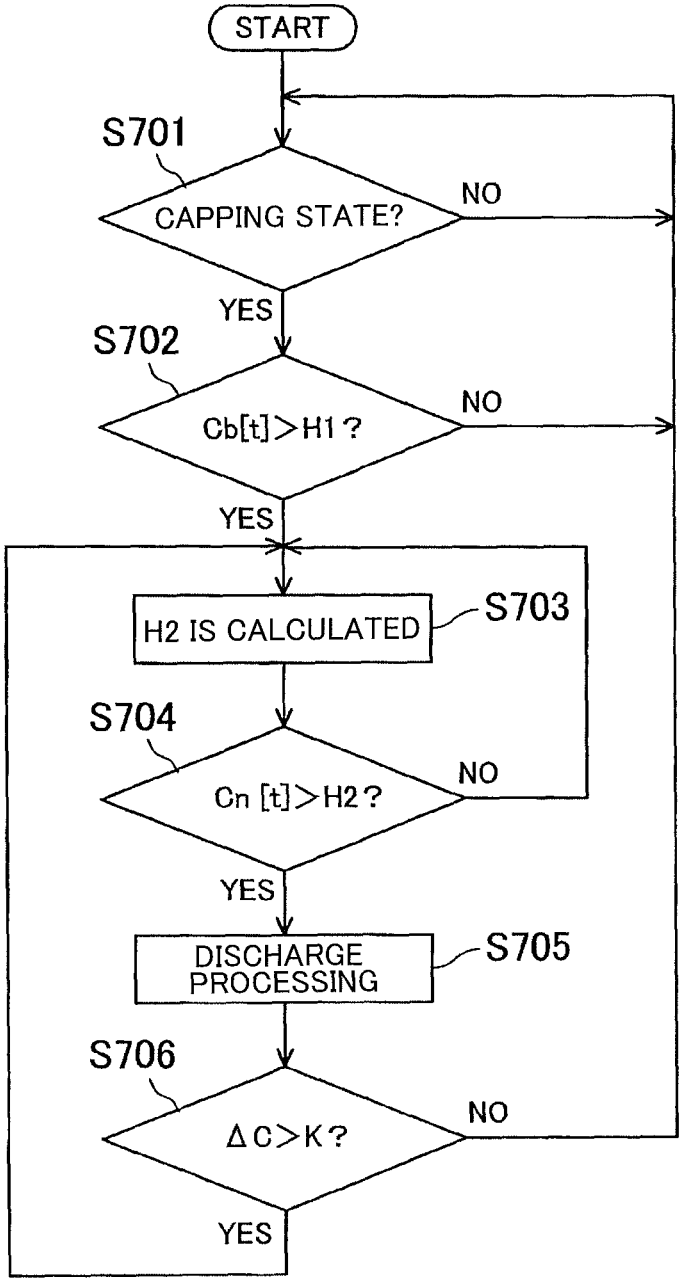
FIG. 11 is a flowchart corresponding to that of FIG. 6 in a first modification.

In the second and third embodiments, the discharge processing is performed when the equilibrium evaporation rate Cb[t] exceeds the first threshold H1 at S402 and the nozzle evaporation rate Cn[t] subsequently exceeds the second threshold H2 at S403. The discharge processing may be performed even when the condition at S403 is not satisfied. That is, the discharge processing may be performed when the equilibrium evaporation rate Cb[t] exceeds the first threshold H1 at S402. While the second threshold H2 is a constant value in the second and third embodiments, the present disclosure is not limited to this configuration. In a first modification shown in FIG. 11, the controller 50 executes processings at S701, S702 similar to those at S401, S402 in the second the embodiment. After it is determined at S702 whether Cb[t] is larger than the first threshold H1, the controller 50 calculates the second threshold H2 (S703). At S703, a value Cb[t]×α, which is obtained by multiplying a current equilibrium evaporation rate Cb[t] by a coefficient α ($0<\alpha<1$), is calculated as the second threshold H2. Here, a value of the coefficient α is a constant stored in the EEPROM 54 (e.g., 0.5). Subsequently, at S704 similar to S403, the controller 50 waits until the nozzle evaporation rate Cn[t] becomes lager than the second threshold H2 (S704:NO). When the nozzle evaporation rate Cn[t] becomes larger than the second threshold H2 (S704:YES), the discharge processing similar to that at S404 is performed (S705). When the difference ΔC[t] between the evaporation rates is larger than the predetermined value K (S706:YES), the control flow goes back to S703. On the other hand, when the difference ΔC[t] between the evaporation rates is not larger than the predetermined value K (S706:NO), the control flow goes back to S701.

Figure 12:
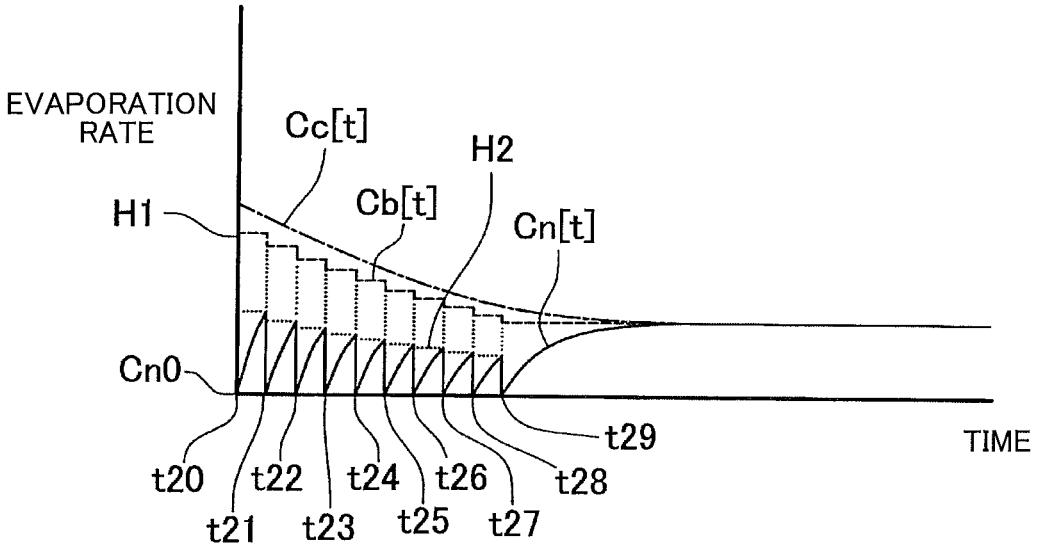
FIG. 12 is a view corresponding to that of FIG. 8 in the first modification.

FIG. 12 shows one example of changes, with time, of the nozzle evaporation rate Cn[t], the cap evaporation rate Cc[t], and the equilibrium evaporation rate Cb[t] after the equilibrium evaporation rate Cb[t] becomes larger than the first threshold H1, in the first modification. In FIG. 12, the solid line indicates the nozzle evaporation rate Cn[t], the long dashed short dashed line indicates the cap evaporation rate Cc[t], and the dashed line indicates the equilibrium evaporation rate Cb[t]. In FIG. 12, time t20 indicates timing at which the equilibrium evaporation rate Cb[t] becomes larger than the first threshold H1 and the nozzle evaporation rate Cn[t] becomes larger than the second threshold H2. Further, each of times t20-t29 is timing at which the discharge processing is performed.

As shown in FIG. 12, when the discharge processing is repeated, the cap evaporation rate gradually decreases, so that the equilibrium evaporation rate gradually decreases. Further, the difference ΔC[t] between the nozzle evaporation rate and the cap evaporation rate gradually becomes smaller, so that the evaporation rates become closer to the equilibrium evaporation rate. Consequently, water in the ink in the nozzles 10 is unlikely to move to the ink in the cap portion 21*a*, 21*b*. If the second threshold H2 is constant, the length of time required for the nozzle evaporation rate Cn[t] to reach the second threshold H2 after completion of the discharge processing is longer in the discharge processings that are later performed, resulting in an increase in a time before the difference ΔC[t] between the evaporation rates becomes equal to or smaller than the predetermined value K, namely, resulting in an increase in a time before repetition of the flushing is stopped.

In the first modification, therefore, the second threshold H2 is calculated by multiplying the equilibrium evaporation rate Cb[t] by the coefficient α. In this instance, as shown in FIG. 12, the equilibrium evaporation rate Cb[t] becomes smaller with an increase in the number of repetitions of the discharge processing, and the second threshold H2 accordingly becomes smaller. It is thus possible to decrease the length of time required for the nozzle evaporation rate Cn[t] to become equal to or smaller than the second threshold H2 and to perform a next discharge processing after the capping state has been maintained only in a time period during which the movement of water is likely to proceed. In this instance, although the number of the discharge processings repeatedly performed until the difference ΔC[t] between the evaporation rates becomes equal to or lower than the predetermined value K increases, it is possible to decrease the length of time required for the difference ΔC[t] between the evaporation rates to become equal to or smaller than the predetermined value K.

While the coefficient α is a constant value in the first modification, the present disclosure is not limited to this configuration. For instance, the value of the coefficient α may be made larger with an increase in the temperature S detected by the temperature sensor 59, and the second threshold H2 may be calculated based on the coefficient α. The movement of water, in the capping state, from the ink in the nozzles 10 to the ink in the cap portions 21*a*, 21*b* is more likely to proceed with an increase in the temperature S. Thus, the value of the coefficient α is made larger with an increase in the temperature S, and the second threshold H2 is accordingly made larger, whereby it is possible to minimize the number of flushings repeatedly performed until the difference ΔC[t] between the evaporation rates becomes equal to or smaller than the predetermined value K.

Alternatively, the coefficient α may be changed depending upon the number of repetitions of the discharge processing performed after the equilibrium evaporation rate Cb[t] has exceeded the first threshold H1 at S402, and the second threshold H2 may be calculated based on the coefficient α. The manner of the movement of water from the ink in the nozzles 10 to the ink in the cap portions 21*a*, 21*b* in the capping state after the flushing differs for every discharge processing. It is thus possible to appropriately calculate the value of the second threshold H2 by changing the coefficient α depending upon the number of repetitions of the discharge processing.

In the second and third embodiments, while the discharge processing is repeated every time when the nozzle evaporation rate Cn[t] becomes larger than the second threshold H2, the discharge processing may be repeated at intervals of a predetermined length of time.

In the second and third embodiments, the repetition of the discharge processing is stopped when the difference ΔC[t] of the evaporation rates becomes equal to or smaller than the predetermined value K. The present disclosure is not limited to this configuration. The discharge processing may be repeated always only by a predetermined number of times after the equilibrium evaporation rate Cb[t] has become larger than the first threshold H1, for instance.

Further, the discharge processing does not necessarily have to be repeated. For instance, the first threshold H1 may be set at a smaller value, and the discharge processing may be performed only once when the equilibrium evaporation rate Cb[t] becomes larger than the first threshold H1.

In the second and third embodiments, the nozzle evaporation rate Cn[t] is reset to the initial value C0 when the flushing is performed or when the printing is performed. The present disclosure is not limited to this configuration. In an instance where the flushing amount is small, the ink in the nozzle 10 is not completely replaced. That is, the ink present in a deep portion of the nozzle 10 that is farther from its opening moves toward the opening. In such an instance, when the flushing is performed in the third embodiment, the water weight Wn[i] in each nozzle region Rn[i] may be replaced with the water weight Wn[i+a] in the nozzle region Rn[i+a] located farther from the opening of the nozzle 10, by setting the water weight to Wn[1]=Wn[2], Wn[2]=Wn[3], for instance.

In the second and third embodiments, the discharge processing is performed when the equilibrium evaporation rate Cb[t] becomes larger than the first threshold H1. The present disclosure is not limited to this configuration. For instance, the discharge processing may be performed at intervals of a predetermined time duration of the capping state, and the discharge amount of the ink by the flushing in the discharge processing may be increased with an increase in the equilibrium evaporation rate Cb[t] at the time when the discharge processing is performed.

Moreover, the discharge processing does not necessarily have to be performed based on the equilibrium evaporation rate Cb[t]. For instance, the discharge processing may be performed when the nozzle evaporation rate Cn[t] calculated according to the relational expression (1) in the capping state exceeds a predetermined threshold. Also in this case, the calculated nozzle evaporation rate Cn[t] is accurate, and it is thus possible to minimize the discharge amount of the ink when the discharge processing is performed based on the nozzle evaporation rate Cn[t].

In the second and third embodiments, the cap evaporation rate per se is used as the cap parameter, the nozzle evaporation rate per se is used as the nozzle parameter, and the equilibrium evaporation rate per se is used as the equilibrium parameter. The present disclosure is not limited to this configuration. Another parameter relating to the cap evaporation rate may be used as the cap parameter, another parameter relating to the nozzle evaporation rate may be used as the nozzle parameter, and another parameter relating to the equilibrium evaporation rate may be used as the equilibrium parameter.

In the second and third embodiments, the ink is ejected, in the flushing, from the nozzles 10 to the flushing foam 7 disposed outside the cap 21. The present disclosure is not limited to this configuration. In the flushing, the ink may be discharged from the nozzles 10 to the cap portions 21*a*, 21*b*. In this case, the cap evaporation rate is decreased due to water in the ink discharged to the cap portions 21*a*, 21*b* and the movement of water from the ink in the nozzles 10 to the ink in the cap portions 21*a*, 21*b*.

While the nozzle evaporation rate and the cap evaporation rate are decreased by the flushing in the second and third embodiments, the evaporation rates may be decreased otherwise. For instance, the nozzle evaporation rate and the cap evaporation rate may be decreased by performing the suction purging when the equilibrium evaporation rate Cb[t] becomes larger than the first threshold H1 and the nozzle evaporation rate Cn[t] thereafter becomes larger than the second threshold H2. In this instance, the ink in the nozzles 10 and the ink in the cap portions 21*a*, 21*b* are replaced by the suction purging. Accordingly, the nozzle evaporation rate Cn[t] and the cap evaporation rate Cc[t] stored in the RAM 53 (which will be the evaporation rates Cn[t−1], Cc[t−1] used for next calculation of the evaporation rates Cn[t], Cc[t]) are reset respectively to the initial values Cn0, Cc0 after the suction purging. It is noted that the suction purging need not be repeated.

Figure 13:
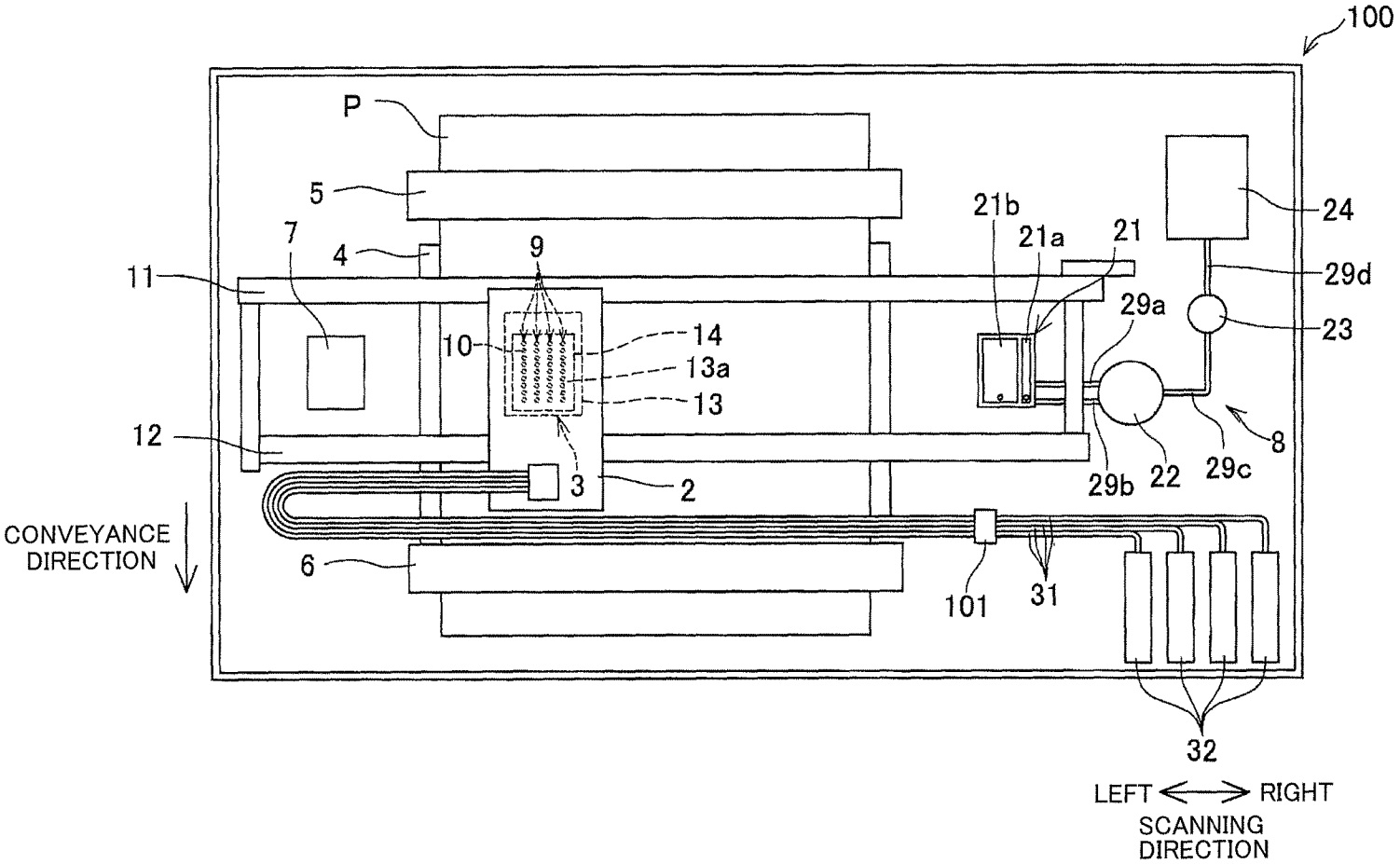
FIG. 13 is a view corresponding to that of FIG. 1 in a second modification.

In a printer 100 according to a second modification shown in FIG. 13, a pressurizing pump 101 is provided at a portion of the four tubes 31. The pressurizing pump 101 is configured to selectively pressurize one of: the ink in the tube 31 connected to the rightmost ink cartridge 32 in which the black ink is stored; and the ink in the three tubes 31 respectively connected to the left-side three ink cartridges 32 in which the three color ink is stored. Thus, the pressurizing pump 101 pressurizes the ink in the ink jet head 3. With this configuration, when the pressurizing pump 101 is driven in the capping state, a positive pressure is given to the ink in the ink jet head 3, so that the ink is discharged from the nozzles 10 to the cap portions 21*a*, 21*b*. Thus, a positive-pressure purging is performed. The ink discharged to the cap portions 21*a*, 21*b* is discharged to the waste-liquid tank 24 by driving the suction pump 23 in the uncapping state after completion of the positive-pressure purging. In the second modification, the suction pump 23 is one example of "first pump", and the pressurizing pump 101 is one example of "second pump".

In the second modification, the positive-pressure purging may be performed when the equilibrium evaporation rate Cb[t] becomes larger than the first threshold H1 and the nozzle evaporation rate Cn[t] thereafter becomes larger than the second threshold H2, so as to decrease the nozzle evaporation rate and the cap evaporation rate. Also in this case, by the positive-pressure purging, the ink in the nozzles 10 and the ink in the cap portions 21*a*, 21*b* are replaced. Accordingly, the nozzle evaporation rate Cn[t] and the cap evaporation rate Cc[t] stored in the RAM 53 (which will be the evaporation rates Cn[t−1], Cc[t−1] used for next calculation of the evaporation rates Cn[t], Cc[t]) are reset respectively to the initial values Cn0, Cc0 after the positive-pressure purging. It is noted that the positive-pressure purging need not be repeated.

The printer 1 of the second and third embodiments is equipped with the cap elevating and lowering device 58 configured to move the cap 21 upward and downward independently of the movement of the carriage 2. The present disclosure is not limited to this configuration. In a third modification shown in FIGS. 14A and 14B, the cap 21 is supported by a cap holder 111. The cap holder 111 has, at its right end portion in the scanning direction, a protruding portion 112 that protrudes upward to such an extent that the protruding portion 112 overlaps the carriage 2 in the scanning direction. The cap holder 111 is connected, at its opposite ends in the scanning direction, to a frame 114 of the printer through link members 113. Each link member 113 is pivotable relative to the cap holder 111 and the frame 114, at its connection with the cap holder 111 and its connection with the frame 114, about an axis parallel to the conveyance direction (which is a direction orthogonal to the sheet plane of FIG. 14). A spring 115 is disposed between the cap holder 111 and the frame 114, and the cap holder 111 is pulled by the spring 115 toward a lower left side.

Figure 14A:
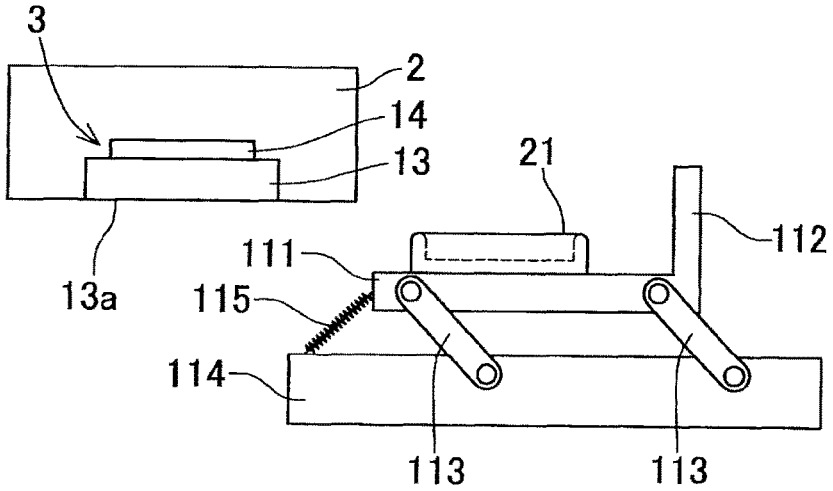
FIG. 14A is a view showing a structure, in a third modification, for elevating and lowering a cap in conjunction with a movement of a carriage, the view showing a state in which the cap is lowered.
Figure 14B:
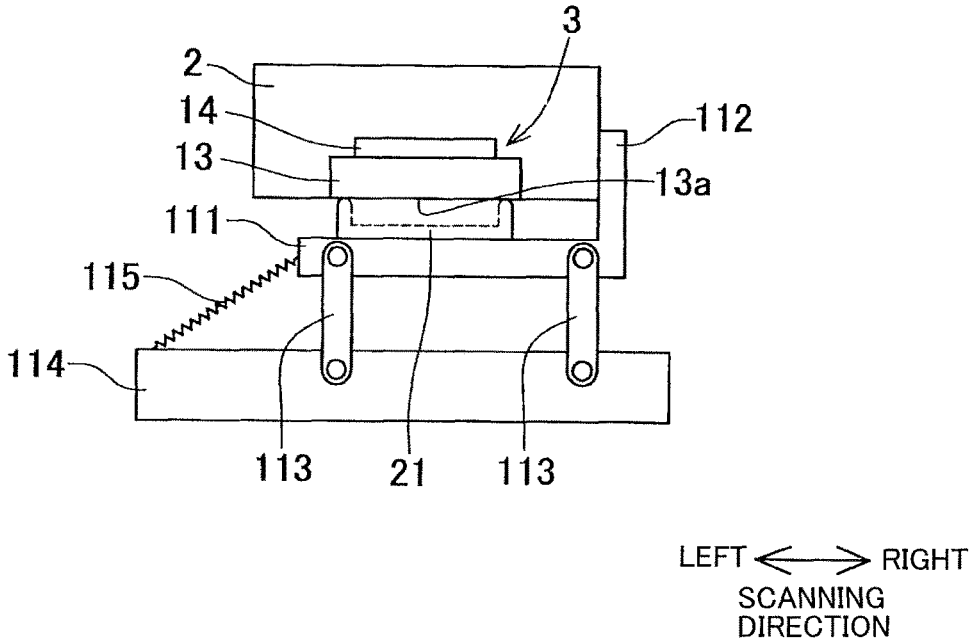
FIG. 14B is a view corresponding to FIG. 14A in a state in which the cap is elevated.

In a state in which the carriage 2 is located to the left of the maintenance position, the cap holder 111 being pulled by the spring 115 is located at a position shown in FIG. 14A. In this state, the upper end of the cap 21 is located at a height level lower than the nozzle surface 13*a*. When the carriage 2 is moved to the maintenance position, the protruding portion 112 of the cap holder 111 is pushed by the carriage 2, so that the cap holder 111 moves rightward against the biasing force of the spring 115 and the link members 113 accordingly pivot so as to move the cap holder 111 upward, as shown in FIG. 14B. As a result, the cap 21 comes into close contact with the nozzle surface 13*a*. In the second modification, the cap 21 moves upward and downward in conjunction with the movement of the carriage 2. In the second modification, the device constituted by the cap holder 111 having the protruding portion 112, the link members 113, the frame 114, and the spring 115 for moving the cap 21 upward and downward in conjunction with the movement of the carriage 2 is one example of "cap moving device" and "switcher".

Figure 15:
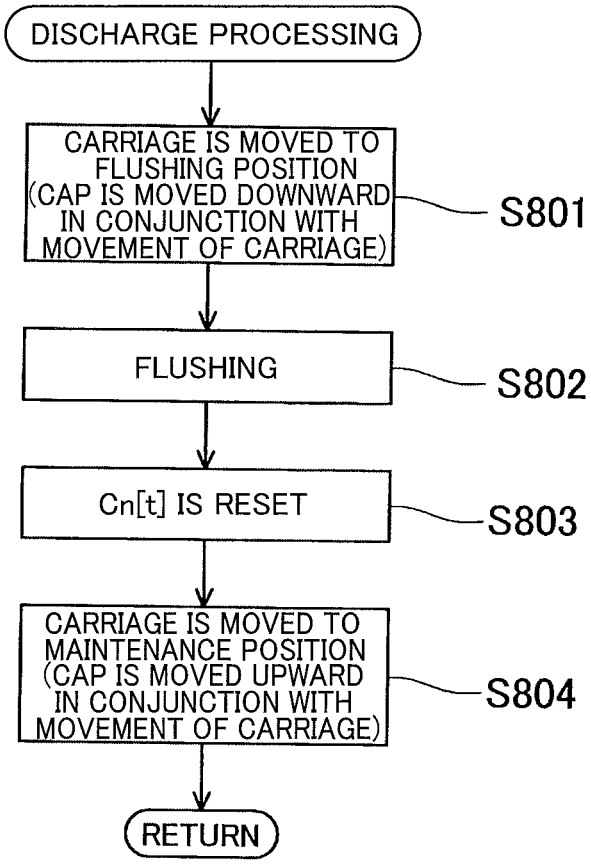
FIG. 15 is a flowchart corresponding to that of FIG. 7 in a third modification.

In the third modification, as shown in FIG. 15, the carriage 2 is moved to the flushing position (S801) in the discharge processing at S403 (FIG. 6). In this instance, the cap 21 is moved downward in conjunction with the movement of the carriage 2. In this state, the flushing is performed (S802), and the nozzle evaporation rate Cn[t] is reset to the initial value C0 (S803). Thereafter, the carriage 2 is moved to the maintenance position (S804). In this instance, the cap 21 is moved upward in conjunction with the movement of the carriage 2, so that the cap 21 comes into close contact with the nozzle surface 13*a*. Thus, the state of the cap 21 returns to the capping state.

In the second and third embodiments, the nozzle evaporation rate Cn[t] and the cap evaporation rate Cc[t] are calculated during standby, and the discharge processing (S404, S705) is performed based on the evaporation rates. The present disclosure is not limited to this configuration. For instance, based on the calculated evaporation rates Cn[t], Cc[t], the pre-printing flushing or the flushing in the regular maintenance may be performed. Further, the flushing need not be necessarily performed based on both of the evaporation rates Cn[t], Cc[t]. In the case where the cap evaporation rate Cc[t] is high, the nozzle evaporation rate will probably become high in future. In view of this, in the second and third embodiments, only the cap evaporation rate Cc[t] may be calculated, and the pre-printing flushing or the flushing in the regular maintenance may be performed based on the calculated cap evaporation rate Cc[t].

In this case, in the pre-printing flushing, it is preferable to determine the degree of thickening of the ink in the nozzles 10 based on the cap evaporation rate Cc[t] at the time when the capping is started, so as to determine the flushing amount. On the other hand, in the flushing of the regular maintenance, it is preferable to determine the degree of thickening of the ink in the nozzles 10 based on the cap evaporation rate Cc[t] at the time when the flushing is performed, so as to determine the flushing amount.

In the above description, the present disclosure is applied to the printer configured to perform printing by ejecting the ink from the nozzles. The present disclosure is not limited to this application. For instance, the present disclosure is applicable to a liquid ejection apparatus configured to eject a liquid other than the ink, such as a material of a wiring pattern for a wiring board.

What is claimed is:

1. A liquid ejection apparatus, comprising:
a liquid ejection head having nozzles;
a cap configured to cover the nozzles;
a pump fluidically connected to the cap;
a switcher configured to switch a state of the cap between a capping state in which the cap contacts the liquid ejection head so as to cover the nozzles and an uncapping state in which the cap is spaced apart from the liquid ejection head; and
a controller,
wherein the controller is configured to:
determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and
control the liquid ejection head based on the determined cap parameter so as to cause the liquid ejection head to perform a flushing for discharging the liquid from the nozzles.

2. The liquid ejection apparatus according to claim 1, further comprising a temperature sensor,
wherein the controller is configured to determine the cap parameter further in consideration of information relating to an ambient temperature measured by the temperature sensor.

3. The liquid ejection apparatus according to claim 1, wherein the controller is configured to determine the cap parameter in consideration of a length of time of the capping state and a length of time of the uncapping state in a period from the most recent discharge of the liquid from the nozzles into the cap to a current time point.

4. The liquid ejection apparatus according to claim 3, further comprising a timer configured to measure the length of time of the capping state and the length of time of the uncapping state,
wherein the controller is configured to determine the cap parameter in consideration of the measured length of time of the capping state and the measured length of time of the uncapping state.

5. The liquid ejection apparatus according to claim 4, wherein the controller is configured to cause the liquid ejection head to perform the flushing based on the cap parameter and the most recently measured length of time of the capping state.

6. The liquid ejection apparatus according to claim 5, further comprising a storage that stores information of a first coefficient set for the length of time of the capping state and information of a second coefficient set for the length of time of the uncapping state, wherein the controller is configured to:

determine the cap parameter in consideration of a value obtained by multiplying the length of time of the capping state by the first coefficient each time when the state of the cap is switched from the capping state to the uncapping state; and determine the cap parameter in consideration of a value obtained by multiplying the length of time of the uncapping state by the second coefficient each time when the state of the cap is switched from the uncapping state to the capping state.

7. The liquid ejection apparatus according to claim 5, wherein the controller is configured to change a discharge amount of the liquid in accordance with the cap parameter and the most recently measured length of time of the capping state.

8. The liquid ejection apparatus according to claim 1, further comprising a storage that stores cap-parameter calculating information for calculating the cap parameter and nozzle-parameter calculating information for calculating a nozzle parameter relating to a nozzle evaporation rate being an evaporation rate of water in the liquid in the nozzles, wherein the controller is configured to:

determine a current nozzle parameter in the capping state in consideration of the cap-parameter calculating information, an immediately preceding cap parameter, and an immediately preceding nozzle parameter; and determine a current nozzle parameter in the capping state in consideration of the nozzle-parameter calculating information, the immediately preceding nozzle parameter, and the immediately preceding cap parameter.

9. The liquid ejection apparatus according to claim 1, wherein the controller is configured to:

determine a nozzle parameter relating to a nozzle evaporation rate which is an evaporation rate of water in the liquid in the nozzles;

determine an equilibrium parameter relating to an equilibrium evaporation rate at which the cap evaporation rate and the nozzle evaporation rate equilibrate in the capping state, in consideration of a value of the cap parameter and a value of the nozzle parameter; and cause the liquid ejection head to perform the flushing based on the determined equilibrium parameter.

10. The liquid ejection apparatus according to claim 9, wherein the controller is configured to cause the liquid ejection head to perform the flushing when the equilibrium parameter exceeds a first threshold.

11. The liquid ejection apparatus according to claim 10, further comprising a liquid receiver, wherein the controller is configured to cause the liquid ejection head to perform a flushing for discharging the liquid from the nozzles toward the liquid receiver, and wherein the controller is configured to repeatedly cause the liquid ejection head to perform the flushing when the equilibrium parameter exceeds the first threshold.

12. The liquid ejection apparatus according to claim 11, wherein the controller is configured to cause the liquid ejection head to perform the flushing when the equilibrium parameter exceeds the first threshold, and wherein the controller is configured to cause the liquid ejection head to perform thereafter the flushing each time when the nozzle parameter exceeds a second threshold smaller than the first threshold.

13. The liquid ejection apparatus according to claim 12, wherein the second threshold is a constant value.

14. The liquid ejection apparatus according to claim 12, wherein the controller is configured to calculate a value obtained by multiplying the equilibrium parameter by a coefficient being larger than 0 and smaller than 1, as the second threshold.

15. The liquid ejection apparatus according to claim 14, wherein the controller is configured to calculate the second threshold by changing a value of the coefficient in accordance with a number of repetitions of the flushing performed after the equilibrium parameter has exceeded the first threshold.

16. The liquid ejection apparatus according to claim 14, further comprising a temperature sensor, wherein the controller is configured to calculate the second threshold by increasing the coefficient with an increase in an ambient temperature detected by the temperature sensor.

17. The liquid ejection apparatus according to claim 11, wherein the controller is configured cause the liquid ejection head to stop repetition of the flushing when a difference between the cap parameter and the nozzle parameter becomes equal to or smaller than a predetermined value.

18. The liquid ejection apparatus according to claim 8, wherein the controller is configured to reset a value of the immediately preceding nozzle parameter to an initial value after the flushing.

19. The liquid ejection apparatus according to claim 18, wherein the controller is configured to cause the liquid ejection head to eject the liquid from the nozzles toward a medium, and, wherein the controller is configured to reset a value of the nozzle parameter to the initial value after ejecting the liquid.

20. The liquid ejection apparatus according to claim 1, wherein the liquid ejection head includes a nozzle surface in which the nozzles are formed, wherein the liquid ejection apparatus further comprises:

a liquid receiver disposed so as to be spaced apart from the cap in a scanning direction parallel to the nozzle surface; and a head moving device configured to move the liquid ejection head in the scanning direction between a first opposed position at which the liquid ejection head is opposed to the cap and a second opposed position at which the liquid ejection head is opposed to the liquid receiver, wherein the switcher includes a cap moving device configured to move the cap in an intersecting direction that intersects the nozzle surface between a capping position at which the cap covers the nozzles and an uncapping position being farther from the liquid ejection head than the capping position, and wherein the controller is configured to:

control the cap moving device to move the cap to the uncapping position and control the head moving device to move the liquid ejection head to the second opposed position, so as to cause the liquid ejection head to perform the flushing for discharging the liquid from the nozzles toward the liquid receiver; and after the flushing, control the head moving device to move the liquid ejection head to the first opposed position and control the cap moving device to move the cap to the capping position, so as to place the cap in the capping state.

21. The liquid ejection apparatus according to claim 1, wherein the liquid ejection head includes a nozzle surface in which the nozzles are formed, wherein the liquid ejection apparatus further comprises:

a liquid receiver disposed so as to be spaced apart from the cap in a scanning direction parallel to the nozzle surface; and a head moving device configured to move the liquid ejection head in the scanning direction between a first opposed position at which the liquid ejection head is opposed to the cap and a second opposed position at which the liquid ejection head is opposed to the liquid receiver, wherein the switcher includes a cap moving device configured to move the cap in an intersecting direction that intersects the nozzle surface by utilizing a force received from the head moving device, the cap moving device is configured to:

position, in a state in which the liquid ejection head is located at the first opposed position, the cap at a capping position at which the cap covers the nozzles; and position, in a state in which the liquid ejection head is located at the second opposed position, the cap at an uncapping position which is farther from the liquid ejection head than the capping position in the intersecting direction, and wherein the controller is configured to:

control the head moving device to move the liquid ejection head to the second opposed position, so as to control the liquid ejection head to perform the flushing for discharging the liquid from the nozzles; and after the flushing, control the head moving device to move the liquid ejection head to the first opposed position, so as to place the cap in the capping state.

22. A liquid ejection apparatus, comprising:

a liquid ejection head having nozzles;

a cap configured to cover the nozzles;

a pump fluidically connected to the cap;

a switcher configured to switch a state of the cap between a capping state in which the cap contacts the liquid ejection head so as to cover the nozzles and an uncapping state in which the cap is spaced apart from the liquid ejection head; and a controller, wherein the controller is configured to:

determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and control the switcher and the pump based on the determined cap parameter to switch the state of the cap to the capping state and thereafter discharge the liquid from the nozzles to the cap.

23. A liquid ejection apparatus, comprising:

a liquid ejection head having nozzles;

a cap configured to cover the nozzles;

a first pump fluidically connected to the cap;

a second pump fluidically connected to the liquid ejection head, the second pump configured to give a pressure for discharging the liquid from the nozzles;

a switcher configured to switch a state of the cap between a capping state in which the cap contacts the liquid ejection head so as to cover the nozzles and an uncapping state in which the cap is spaced apart from the liquid ejection head; and a controller, wherein the controller is configured to:

determine a cap parameter relating to a cap evaporation rate being an evaporation rate of water in a remaining liquid remaining in the cap, in consideration of (i) an amount of water that moves from the liquid in the nozzles to the remaining liquid in the capping state and (ii) an amount of water that evaporates from the remaining liquid in the uncapping state; and control the switcher and the second pump based on the determined cap parameter to switch the state of the cap to the capping state and thereafter discharge the liquid from the nozzles to the cap.

* * * * *